US006460715B1

(12) United States Patent
Yonemori et al.

(10) Patent No.: US 6,460,715 B1
(45) Date of Patent: Oct. 8, 2002

(54) HANDLE FOR PLASTIC BOTTLES AND HANDLE-CARRYING PLASTIC BOTTLE

(75) Inventors: Satoru Yonemori; Akiharu Yoneyama; Yukihide Umezu, all of Kanagawa (JP)

(73) Assignee: Mitsubishi Plastics, Inc., Tokyo (JP)

( * ) Notice: Subject to any disclaimer, the term of this patent is extended or adjusted under 35 U.S.C. 154(b) by 0 days.

(21) Appl. No.: 09/554,856

(22) PCT Filed: Nov. 30, 1998

(86) PCT No.: PCT/JP98/05362

§ 371 (c)(1),
(2), (4) Date: May 18, 2000

(87) PCT Pub. No.: WO99/28200

PCT Pub. Date: Jun. 10, 1999

(30) Foreign Application Priority Data

| | | |
|---|---|---|
| Nov. 28, 1997 | (JP) | 9-327859 |
| Apr. 1, 1998 | (JP) | 10-088707 |
| Apr. 10, 1998 | (JP) | 10-099264 |
| Jun. 22, 1998 | (JP) | 10-174743 |
| Jul. 22, 1998 | (JP) | 10-206389 |

(51) Int. Cl.[7] ..... B65D 23/10
(52) U.S. Cl. ..... 215/396; 215/398
(58) Field of Search ..... 215/396, 398; 220/759, 770, 771

(56) References Cited

U.S. PATENT DOCUMENTS

| | | | | |
|---|---|---|---|---|
| 4,120,073 A | | 10/1978 | Studebaker | 16/114 |
| 4,915,241 A | * | 4/1990 | Morimura et al. | 215/396 |
| 5,819,966 A | * | 10/1998 | Ota et al. | 215/396 |
| 5,988,418 A | * | 11/1999 | Maeshima | 215/396 |

FOREIGN PATENT DOCUMENTS

| | | |
|---|---|---|
| JP | 49-44194 | 7/1974 |
| JP | 54-1182 | 1/1979 |
| JP | 2-99735 | 8/1990 |
| JP | 4-13536 | 2/1992 |
| JP | 6-42670 | 6/1994 |
| JP | 6-156500 | 6/1994 |
| JP | 6-336251 | 12/1994 |
| JP | 7-117104 | 5/1995 |
| JP | 8-80947 | 3/1996 |
| JP | 8-169059 | 7/1996 |
| JP | 9-39971 | 2/1997 |
| JP | 9-39972 | 2/1997 |
| JP | 9-39973 | 2/1997 |
| JP | 9-254986 | 9/1997 |

* cited by examiner

*Primary Examiner*—Nathan J. Newhouse
(74) *Attorney, Agent, or Firm*—Knobbe, Martens, Olson & Bear, LLP

(57) ABSTRACT

This invention provides a plastic bottle with a handle manufactured by mounting a handle comprising a grip and laterally-protruding fitting arms at both upper and lower ends of the grip on a concave for mounting a handle formed in the side of the bottle body by embedding the ends of the fitting arms into the wall in the concave, characterized in that the handle comprises a protruding piece in the upper part, but not in the lower part, of the end of the lower fitting arm.

47 Claims, 36 Drawing Sheets

HANDLE FOR PLASTIC BOTTLES AND HANDLE-CARRYING PLASTIC BOTTLE

This application is the U.S. National Phase under 35 U.S.C. §371 of International Application PCT/JP98/05362, filed Nov. 30, 1998 which claims priority based on Japanese Patent Application Nos. 9-327859, 10-088707, 10-099264, 10-174743, and 10-206389, filed Nov. 28, 1997, Apr. 1, 1998, Apr. 10, 1998, Jun. 22, 1998, and Jul. 22, 1998, respectively.

BACKGROUND OF THE INVENTION

1. Field of the Invention

This invention relates to a plastic bottle with a handle manufactured by separately preparing a handle for a plastic bottle and a bottle body with a concave in its side for mounting a handle and then mounting the handle on the concave of the plastic bottle.

2. Description of the Prior Art

Recently, there have been practically used a plastic bottle with a handle manufactured by mounting a separate handle on a bottle body made of a plastic material such as a polyester resin, typically polyethylene terephthalate, which is lighter and more shock-resistant than glass. Among others there have been widely marketed a plastic bottle with a handle manufactured by mounting a handle comprising a grip and laterally-protruding fitting arms at both upper and lower ends of the grip on a concave for mounting a handle formed in the side of the bottle body by embedding the ends of the fitting arms into the wall in the concave.

Such a plastic bottle with a handle is manufactured, as shown in the front cross section of FIG. 3, by presetting a separate handle 3 in a blow mold in a manner that the ends of the fitting arms 32, 33 protrude in the mold, and then blow-molding a bottle body I in the mold while wrapping the bottle wall 10 over the ends of the fitting arms 32, 33 to provide an assembled product. Furthermore, at the ends of the fitting arms 32, 33 are formed protruding pieces 321, 342 which are also embedded in the bottle 10 to prevent the handle from slipping out.

However, when the handle 3 is made of a resin less slippery to the bottle body (e.g., the same material as that of the bottle body 1) in the above conventional plastic bottle with a handle, if the bottle wall 21 under the lower fitting arm 33 may become extremely thinner so that bottle strength or mounting strength of the handle can be reduced to cause significant problems such as a hole in the bottle wall.

SUMMARY OF THE INVENTION

Attempting to solve the above problems, we have intensely investigated and have finally found that when the handle is made of a resin less slippery to the bottle body, the bottle wall is rubbed against the lower protruding piece of the lower fitting arm of the handle to be damaged or excessively extended during blow-molding the bottle body while assembling the body and the handle and that an outer bottle wall tends to become thinner. Thus, this invention provides a handle for a plastic bottle comprising a grip and fitting arms laterally protruding from both upper and lower ends of the grip, comprising a protruding piece in the upper part, but not in the lower part, of the end of the lower fitting arm. This invention also provides a plastic bottle with a handle manufactured by mounting a handle comprising a grip and laterally-protruding fitting arms at both upper and lower ends of the grip on a concave for mounting a handle formed in the side of the bottle body by embedding the ends of the fitting arms into the wall in the concave, characterized in that the handle comprises a protruding piece in the upper part, but not in the lower part, of the end of the lower fitting arm. This invention also provides the above plastic bottle with a handle, where a small corrugation is formed on the surface of the protruding piece of the lower fitting arm to be in contact with the bottle body.

In a plastic bottle with a handle according to this invention, there is formed a protruding piece in the upper part, but not in the lower part, of the end of the lower fitting arm. Thus, during blow-molding the bottle body while assembling it and the handle, the bottle wall is relatively less rubbed against the lower surface of the end of the lower fitting arm to be smoothly extended, so that even the outer bottle wall can keep an adequate thickness.

Furthermore, the small corrugation on the surface of the protruding piece of the lower fitting arm to be in contact with the bottle body can minimize a contact area to further reduce friction between the bottle wall and the lower surface of the end of the lower fitting arm in combination with absence of a lower protruding piece, leading to smooth extension.

BRIEF DESCRIPTION OF THE DRAWINGS

FIG. 25(*a*) is a front view, FIG. 25(*b*) is a side view and FIG. 25(*c*) is a cross section taken on line C—C of (b).

FIG. 26(*a*) is a side view, FIG. 26(*b*) is a front view and FIG. 26(*c*) is a bottom view.

FIG. 27(*a*) is a front view and FIG. 27(*b*) is a side view.

FIG. 28(*a*) is a side view and FIG. 28(*b*) is an enlarged bottom view of FIG. (*a*).

FIG. 29(*a*) is a side view and FIG. 29(*b*) is a cross section taken on line A—A of FIG. 29(*a*).

FIG. 30(*a*) is a side view and FIG. 30(*b*) is a cross section taken on line A—A of FIG. 30(*a*).

FIG. 32(*a*) is a front view and FIG. 32(*b*) is a side view.

FIG. 36(*a*) is a front view and FIG. 36(*b*) is a side view.

FIG. 40(*a*) is a front view and FIG. 40(*b*) is a side view.

DETAILED DESCRIPTION OF PREFERRED EMBODIMENTS

In this invention, a bottle body may be prepared by forming a tubular material (referred to as a "preform") as an intermediate product by injection molding of a plastic such as a polyester resin, typically polyethylene terephthalate, setting the preform in a blow mold while heating the preform to its elongation temperature, e.g. 90 to 120° C. for polyethylene terephthalate, and then conducting biaxial-stretching blow molding by introducing high-pressure air into the preform.

In this invention, a handle may be made of, for example, a polyester resin represented by polyethylene terephthalate, polypropylene or polyethylene.

In particular, it is preferable to prepare the handle from a polyester resin as is for the bottle body because it may allow the handle to be processed for recycle together with the body and also to be made of a recycled resin.

This invention will be described with reference to the drawings.

Figure 1:
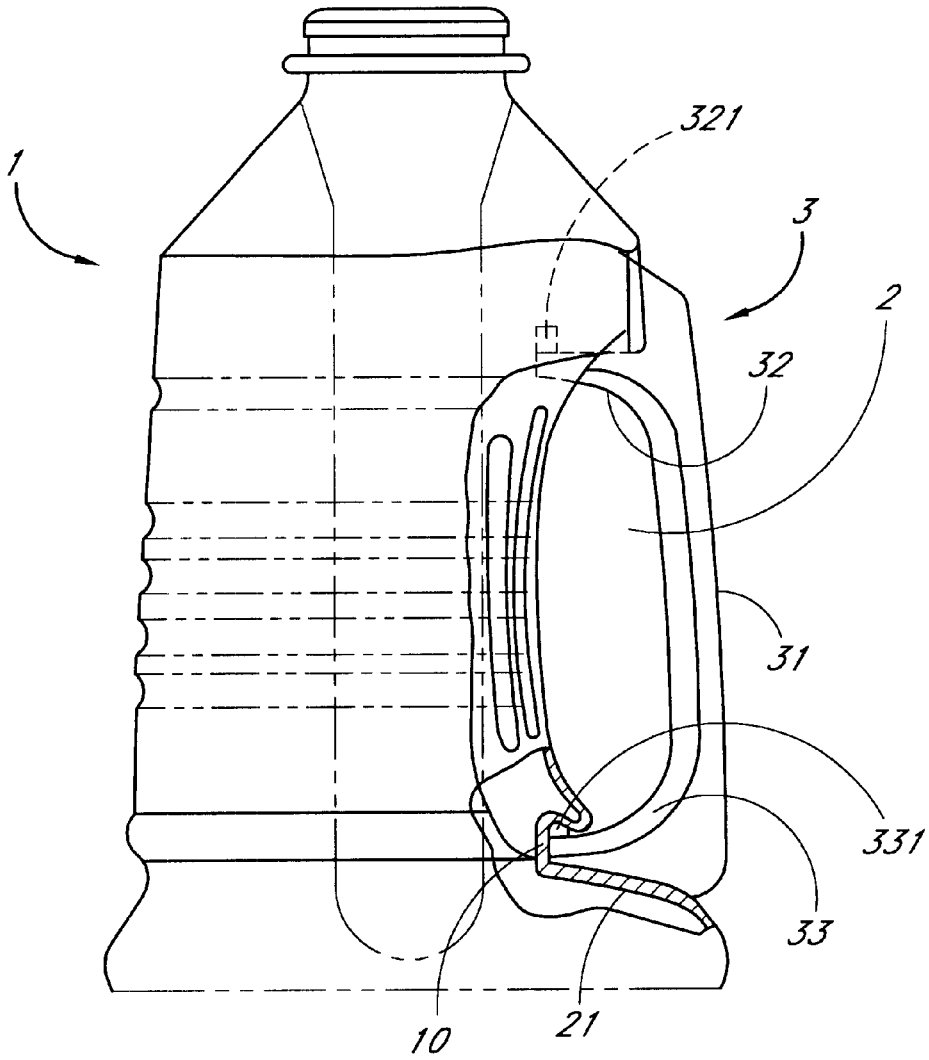
FIG. 1 is a partial front cross section illustrating an embodiment of a plastic bottle with a handle according to this invention.
Figure 2:
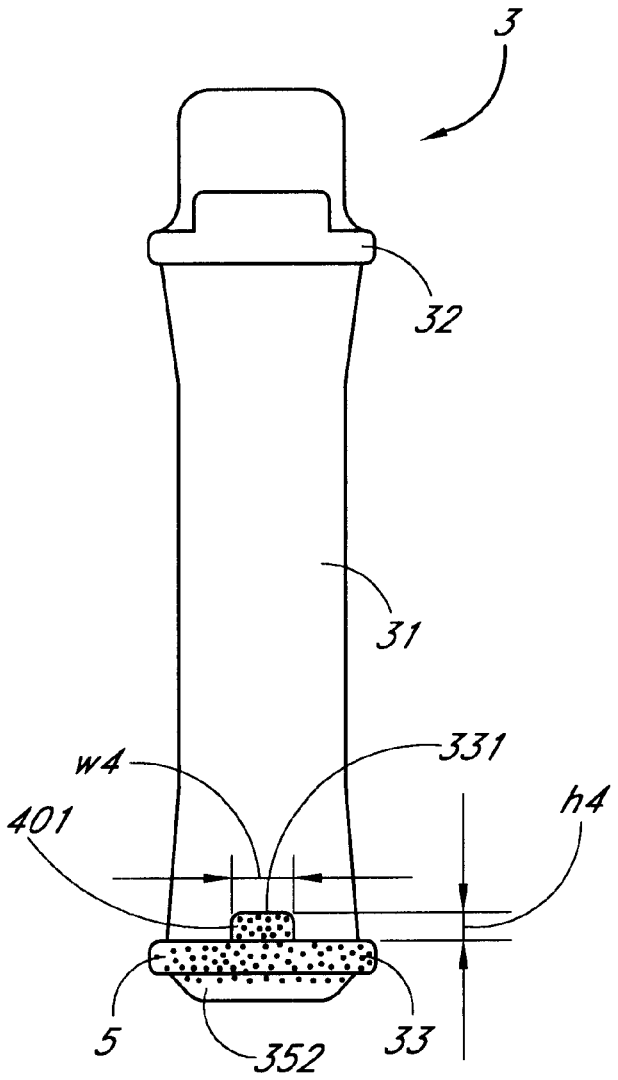
FIG. 2 is a side view of the handle in FIG. 1.
Figure 3:
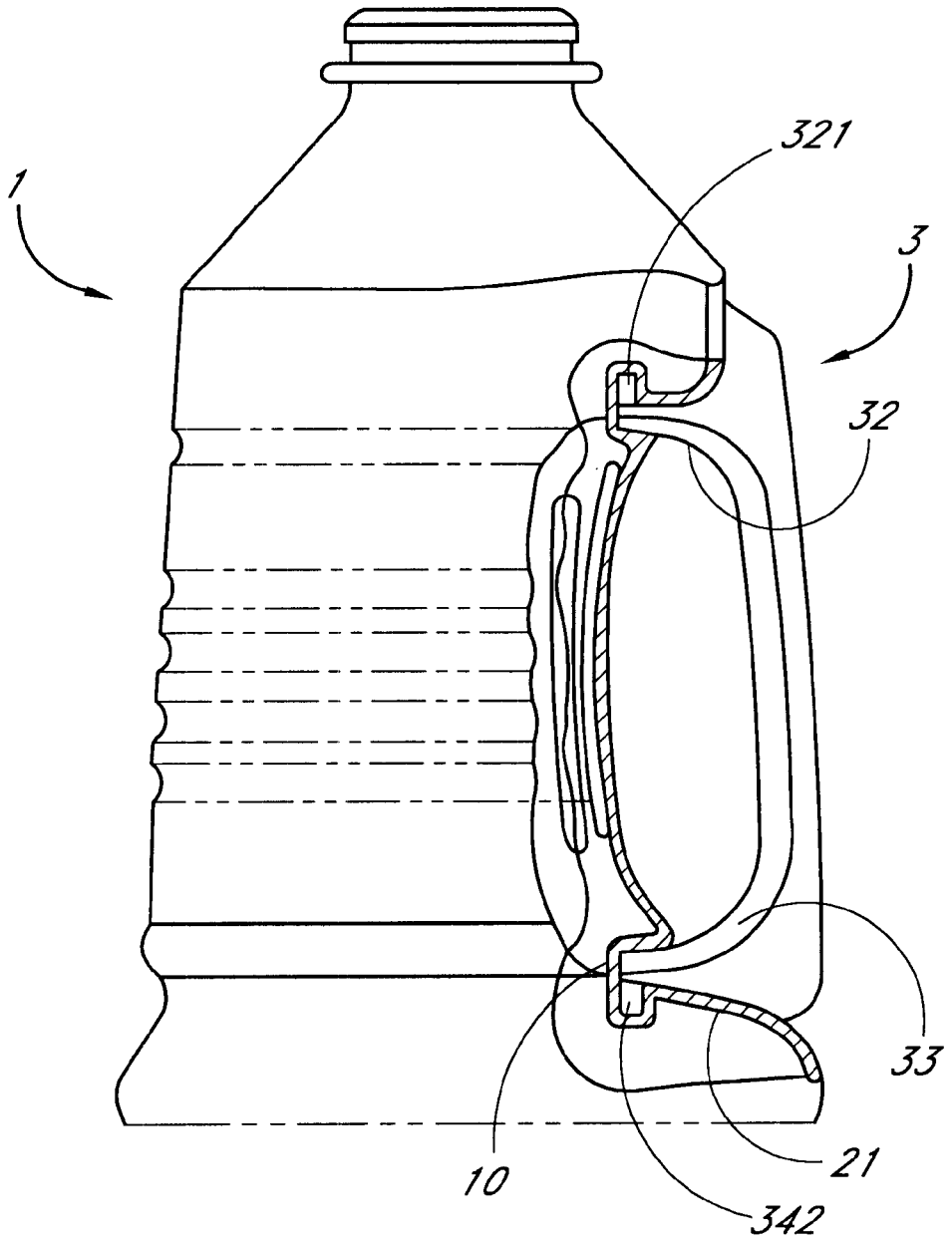
FIG. 3 (PRIOR ART)
FIG. 3 is a partial front cross section illustrating an example of a conventional plastic bottle.

FIG. 1 is a partial front cross section illustrating an embodiment of a plastic bottle with a handle according to this invention. FIG. 2 is a side view of the handle in FIG. 1. FIG. 3 is a partial front cross section illustrating an example of a conventional plastic bottle.

As seen in FIGS. 1 and 2, this invention provides a plastic bottle with a handle manufactured by mounting a handle 3 comprising a grip 31 and laterally-protruding fitting arms 32, 33 at both upper and lower ends of the grip 31 on a concave 2 for mounting a handle formed in the side of the bottle body 1 by embedding the ends of the fitting arms 32, 33 into the wall in the concave 2, characterized in that the handle comprises a protruding piece 331 in the upper part, but not in the lower part, of the end of the lower fitting arm 33. This invention also provides the above plastic bottle with a handle, where a small corrugation 5 is formed on the surface of the protruding piece 331 of the lower fitting arm to be in contact with the bottle body.

There are no particular restrictions to the shape of the handle in this invention as long as it basically has the protruding piece 331 in the upper part, but not in the lower part, of the end of the lower fitting arm 33, the protruding piece preferably has a height h4 of 2 to 5 mm and a width w4 of 5 to 15 mm. If the height h4 is less than 2 mm or the width w4 is less than 5 mm, the piece may be insufficiently engaged with the bottle wall to effectively prevent it from slipping out. If the height h4 is more than 5 mm or the width w4 is more than 15 mm, the bottle wall may inadequately go beyond the protruding piece 331, resulting in problems such as a poor appearance due to a gap between the piece and the upper surface of the fitting arm 33 and less effective prevention of slipping out. Thus, the above limits are preferable.

The small corrugation 5 in this invention may placed in the surface 401 in the protruding piece 331, which is in contact with the bottle body, as illustrated in FIG. 2. It may be extended to the lower surface 352 of the fitting arm 33. piece 6.

The small corrugation 5 in this invention may be a crimp, crape, lattice or groove pattern, having a height of 0.05 to 1.0 mm, preferably 0.05 to 0.5 mm.

The small corrugation 5 may be provided by molding the handle using an injection-molding mold in which a corresponding small corrugation has been formed or by sandblasting or cutting a handle after molding.

Figure 4:
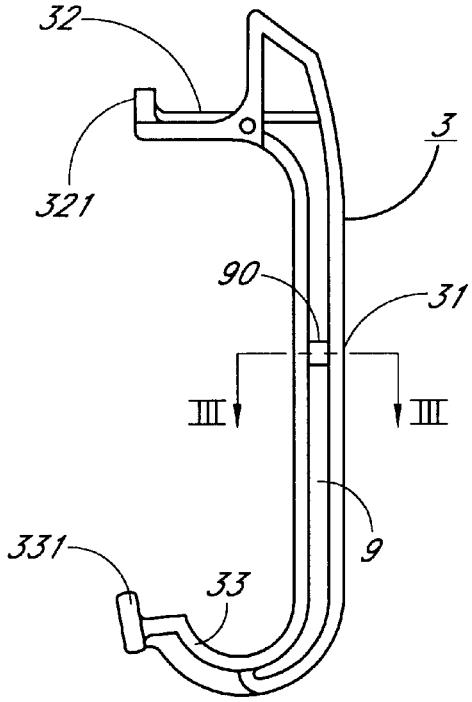
FIG. 4 is a side view of an example of a handle mounted on a plastic bottle with a handle according to this invention.
Figure 5:
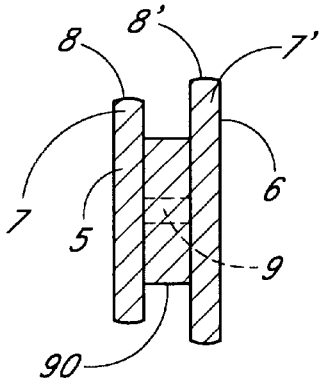
FIG. 5 is a cross section taken on line III—III of FIG. 4.

A handle in this invention, as seen in its side view (FIG. 4) and a cross section taken on line III—III of FIG. 4 (FIG. 5), may have a configuration in which the cross-sectional shape of the grip in the handle is H-shaped and the inner piece is narrower than the outer piece. In FIG. 5, the grip 31 in the handle 3 has an H-shaped cross section in which the inner and the outer pieces 5, 6 are interconnected via a central vertical rib 9 and the inner piece 5 is narrower than the outer piece 6.

Since the inner piece 5 is narrower than the outer piece 6, the handle may fit bent fingers during grasping to be comfortable to a hand. In particular, when the outer piece 6 has a width of at least 12 mm or more to 20 mm or less and the inner piece 5 has a less width than the outer piece 6 by 2 to 3 mm, the handle may be very comfortable to a hand.

It is more preferable for making the handle more comfortable to a hand that the outer R 7, 7' are larger while the inner R 8, 8' is smaller, specifically the outer R is 1.5 to 5 times as large as the inner R, although it depends on the thicknesses of the inner and the outer pieces 5, 6 in the handle.

In the embodiment shown in FIG. 4, the handle 3 comprises laterally-extending fitting arms 32, 33 in the upper and the lower parts of the grip 31 and protruding pieces 321, 331 at the ends of the fitting arms 32, 33, respectively. The handle is mounted on the bottle in a manner that the protruding pieces 321, 331 are embedded into the inner bottle wall in the concave 2 for mounting a handle.

As shown in FIGS. 4 and 5, a lateral rib 90 perpendicular to the central vertical rib 9 may be provided in the center of the grip 31 between the inner and the outer pieces 5, 6 for reinforcement.

Figure 6:
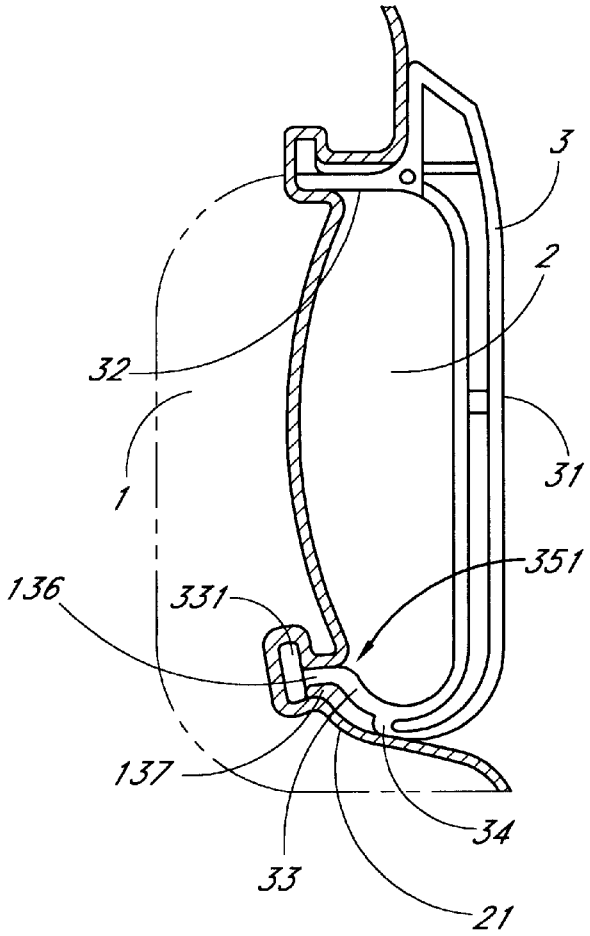
FIG. 6 is a side view of an example of a handle mounted on a plastic bottle with a handle according to this invention.

A handle in this invention, as seen in its side view (FIG. 6) and a partial perspective view illustrating the status near the border where the lower end of the lower fitting arm in FIG. 6 is in contact with the bottle wall (FIG. 7), may comprise a fitting 351 whose lateral cross section in a part connected to the protruding piece 331 formed at the end of the lower fitting arm 33 is T-shaped or cruciform consisting of a lateral wall 136 and a vertical wall 137 downwardly adjacent to the lateral wall 136 in almost its center.

Figure 7:
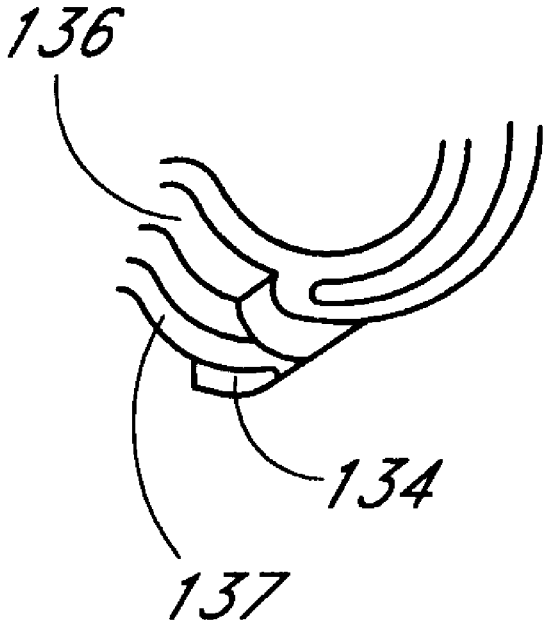
FIG. 7 is a partial perspective view illustrating the status near the border where the lower end of the lower fitting arm is in contact with the bottle wall in FIG. 6.

As seen in FIGS. 6 and 7, the handle may have a configuration where the contact surface of the lower fitting arm 33 near the border where the lower fitting arm 33 is in contact with the bottle wall 21 is relatively wider.

The T-shaped or cruciform lateral cross section can reinforce the fitting 351 so sufficiently for the fitting to be well tolerable to a stress during enfolding the fitting 351 by the bottle wall 21. Furthermore, since the bottle wall 21 is in contact with the lower surface of the vertical wall 37 with a small contact area, a frictional stress may be reduced, so that a region from the protruding piece 331 to the fitting 351 can be smoothly enfolded and thus that the handle 3 can be reliably mounted on the bottle body 1 and deformation of the handle 3 can be effectively prevented during mounting the handle 3.

In addition, for a handle made of a polyester resin, it may be evenly cooled during injection molding and therefore, whitening due to partial crystallization may be minimized.

The wider contact surface of the lower fitting arm 33 near the border where the lower fitting arm 33 is in contact with the bottle wall 21 can disperse a stress transmitted to the bottle wall 21 to prevent the bottle wall 21 from being deformed and thus to prevent the handle 3 from being deformed during mounting the handle 3.

Figure 8:
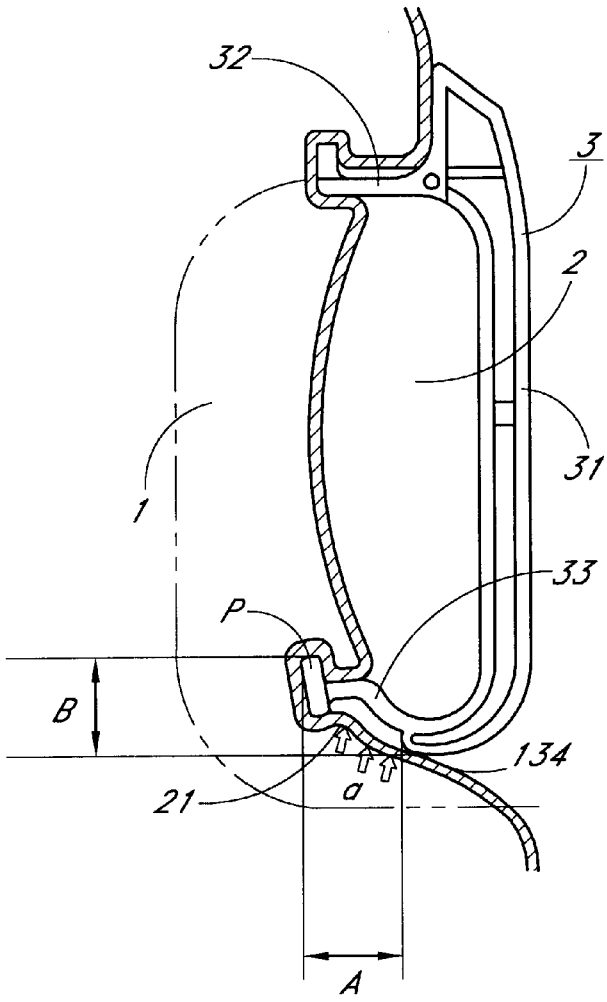
FIG. 8 is a side view of an example of a handle mounted on a plastic bottle with a handle according to this invention.

In the handle in this invention, as seen in its side view of FIG. 8, a protruding piece P is provided in the upper part of the end of the lower fitting arm 33 of the handle 3, the lowest end 134 of the lower fitting arm 33 is almost in the longitudinal center of the lower fitting arm 33, and the height B from the lowest end 134 to the end of the lower fitting arm 33 is 0.5 to 2.5 times as large as the horizontal distance A from the lowest end 134 of the handle 3 to the end of the lower fitting any 33.

The height B less than 0.5 folds of the horizontal distance A is undesirable because the end of the protruding piece P may inhibit enfolding by the bottle wall 21 when the bottle wall 21 enfolds around the protruding piece P of the lower fitting arm 33 of the handle 3 as indicated by an arrow during molding the bottle, so that the handle 3 may be easily removed from the bottle body 1. On the other hand, B more than 2.5 folds of A is also undesirable because it may be apt to cause deformation of the arm due to a stress when grasping the handle 3 in use.

The above embodiment can not only allow the handle 3 to be firmly mounted on the bottle body 1 but also prevent the handle from being deformed during mounting the handle probably because the bottle wall 21 enfolding the protruding piece P of the end of the lower fitting arm 33 may become in contact with the lower surface of the lower fitting arm 33 while it has not been much extended, so that it can support the lowest end 134 as indicated by an arrow a. Furthermore, since the lowest end 134 of the lower fitting arm 33 is almost in the longitudinal center of the handle, the handle 3 can be formed with a minimum amount of material without forming an unnecessary dead space into which a finger cannot smoothly enter.

Thus, the protruding piece can be firmly enfolded by the bottle wall and the arm of the handle may not be deformed due to a stress when grasping the handle in use.

The plastic bottle with a handle according to this invention may comprise a bottle body made of a polyester resin mainly consisting of polyethylene terephthalate and a handle made of a recycled polyester resin mainly consisting of polyethylene terephthalate whose intrinsic viscosity is 0.68 or less. It is preferable that at least the surface of the handle is whitened by crystallization.

The polyester resin constituting the bottle body is generally a homopolymer of polyethylene terephthalate comprising ethylene terephthalate as a main repeating unit, but the terephthalate moieties may be partially replaced with, for example, isophthalate or 2,6-naphthalenedicarboxylate. The ethylene glycol moieties may be partially replaced by, for example, diethylene glycol or propylene glycol. The polyester resin constituting the handle is a recycled resin from a molding such as the above polyester-resin bottle or a virgin material. It is generally a resin prepared by crushing a bottle into flakes, which are then subject to processed such as washing and drying and subsequently are pelletized with an extruder with heating. Although it is most preferable that the polyester resin is a 100% recycled resin in terms of effective utilization of a recycled material, it is not always necessary to use a 100% recycled material. At least, it is necessary that flakes or pellets before being molded into a handle or a molded handle has an intrinsic viscosity (intrinsic viscosity:

a viscosity determined at 20° C. for a sample dissolved in a 40:60 mixture of tetrachloroethane/phenol) of 0.68 or less, generally 0.65 to 0.55.

It is also preferable that the molded handle is made of a recycled polyester resin mainly comprising polyethylene terephthalate whose intrinsic viscosity is 0.68 or less, and at least the surface of the handle is whitened by crystallization of spherocrystals.

The recycled polyester resin constituting the handle has an intrinsic viscosity of 0.68 or less, generally 0.65 to 0.55. If it is 0.69 or more, crystallization may not proceed below a relatively higher temperature of about 100° C., leading to energy loss in whitening.

On the other hand, an intrinsic viscosity of 0.68 or less, generally 0.65 to 0.55 may allow crystallization to be accelerated with minimum energy loss in whitening, even if the crystallization proceeds at a relatively low temperature of about 90° C. or lower.

It is because a recycled polyester resin with a lower intrinsic viscosity has a lower programmed-temperature. crystallization temperature after melting and quenching (a programmed-temperature crystallization temperature (Tcc) is determined by warming a sample at a programming rate of 10° C./min after melting it at 300° C.) of 110 to 140° C. compared to that of a virgin polyester resin of 150 to 200° C. as its intrinsic viscosity, its molecular weight, is reduced.

At least the surface of the handle can be whitened through crystallization of spherocrystals by heating it at about 90° C., a relatively low temperature, to form a crystallization region.

Such whitening only the surface is preferable because energy for whitening can be minimized and it is considerably effective in making an yellowish color less noticeable.

The whole surface of the handle may be whitened and it may be easily achieved by heating at a higher temperature for a longer period.

Thus, crystallization for whitening the handle can be readily conducted at a relatively lower temperature, leading to less energy loss. In addition, since at least the surface of the handle is whitened through crystallization of spherocrystals, a slightly yellowish color due to heat history during a recycle process can become less noticeable.

The handle in this invention may be made of a whitened polyester. Whitening only the surface of the polyester-resin handle is significantly advantageous because heating energy and a duration for whitening may be reduced. In a handle having the structure illustrated in FIG. 4, 5, 6 or 8, whitening the outer surface of the rear plate and the outer surface (front surface) of the front plate which are apparently most noticeable not only is effective in making the inner structure or yellowing less noticeable, but also allows heating energy and a duration for whitening to be considerably minimized. In addition, the top or side surface of the grip may be, of course , whitened.

A handle may be whitened by heating a polyester bottle with a handle at 110 to 200° C. for 10 to 60 sec. after molding or by gradually cooling while injection-molding the handle.

Thus, a reinforcing rib, partial whitening, a surface sink or bubbles can be made less noticeable, leading to an improved appearance of the handle. In addition, whitening the handle may improve its strength to be thinner, leading to reduction in the weight of the bottle body.

Figure 9:
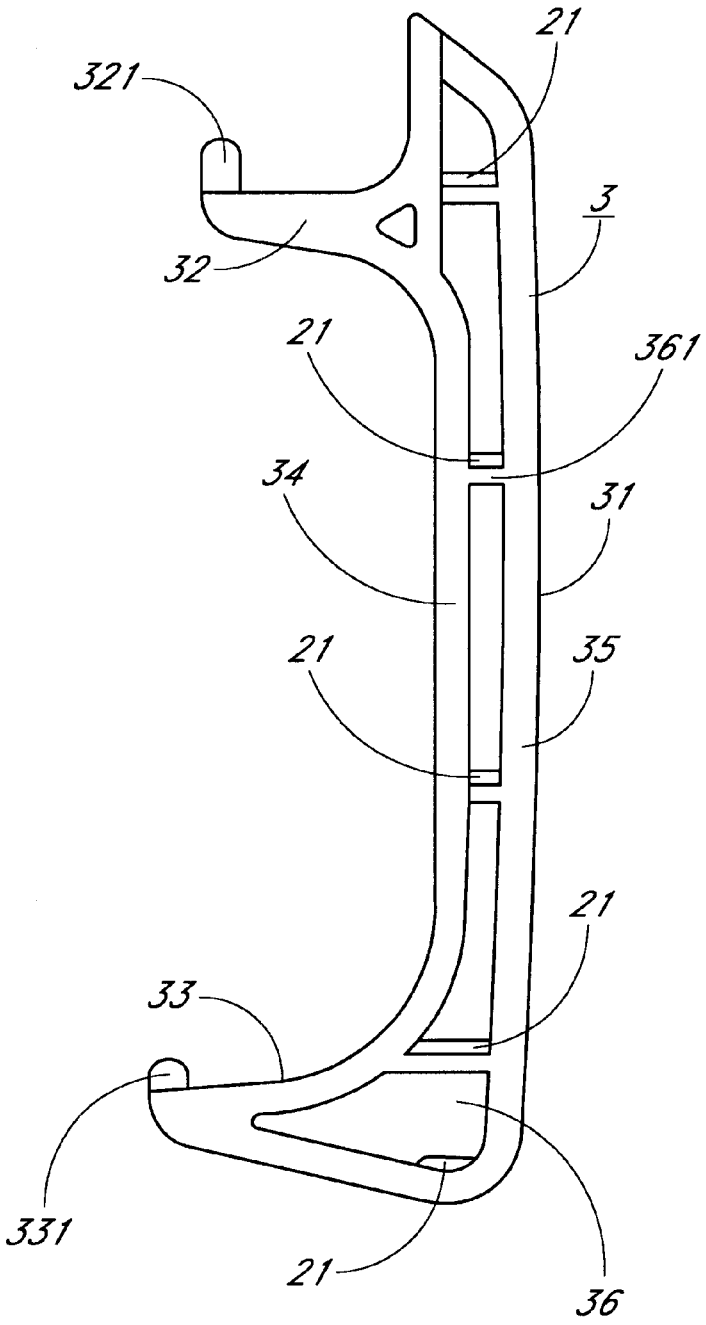
FIG. 9 is a side view of an example of a handle mounted on a plastic bottle with a handle according to this invention.

A handle in this invention, as illustrated in its side view of FIG. 9, may have an H-shaped lateral cross section from a grip in the handle to its upper and lower fitting arms where an inner plate is interconnected with an outer plate via a central rib, and may comprise a lateral rib perpendicular to the central rib where there is formed a drain hole penetrating the central rib above the lateral rib.

The handle illustrated in FIG. 9 has an H-shaped lateral cross section from a grip 31 in the handle 3 to its upper and lower fitting arms 32, 33 where an inner plate 34 is interconnected with an outer plate 35 via a central rib 36, and comprises a lateral rib 361 perpendicular to the central rib 36 where there is formed a drain hole 362 penetrating the central rib 36 above the lateral rib 361.

In the embodiment illustrated in FIG. 9, there are formed a plurality of lateral ribs 361 perpendicular to the central rib 36 at appropriate intervals, and a drain hole 362 penetrating the central rib 36 above each lateral rib 361. Lateral ribs 361 may be, however, formed at two positions; the upper and the lower ends, but not at intermediate positions, where only one drain hole 362 (not shown) may be formed above the lateral rib 361 at the lower end.

Although in the embodiment of FIG. 9, the drain hole 21 is formed above the lateral rib 362 because the plastic bottle with a handle is frequently handled in an erected state, a drain hole 362 penetrating a central rib 36 may be formed below the lateral rib 361 for drain in an inverted state (not shown).

The inner and the outer plates 34, 35 of the grip 31 in the handle 3 are platy, so that their surfaces can be finished to give smooth touch when being grasped.

The H-shaped lateral cross section from the grip 31 in the handle 3 to its upper and lower fitting arms 32, 33 where the inner plate 34 is interconnected with the outer plate 35 via the central rib 36 may allow the overall handle 3 to have a reduced weight maintaining adequate strength, and the grip 31 to have a moderate elasticity, leading to soft and good touch when being grasped.

The H-shaped lateral cross section may simplify the structure of an injection-molding mold because the mold may be moved only in the open side during injection molding.

Interconnecting the inner plate 34 with the outer plate 35 in the handle 3 via a plurality of lateral ribs 361 perpendicular to the central rib 36 and arranged at appropriate intervals may allow the grip 31 to be reinforced without deteriorating its overall light-weight structure.

When the handle is made of a strong plastic such as a polyester resin (e.g., polyethylene terephthalate), the lateral ribs 361 may be provided only two positions; the upper and the lower ends (not shown).

In this embodiment, the bottle body from a lateral direction after washing it with, e.g., water may be air-blown to remove not only residual water in the handle 3 having an H-shaped lateral cross section but also residual water on the lateral ribs 361 by an air stream passing through the drain hole 362 penetrating the central rib 36.

According to this embodiment, water drops cab be surely removed with air after washing the bottle body with, e.g., water, and therefore, there may remain no adhering water.

Furthermore, the overall handle may have a reduced weight maintaining adequate strength, and the grip may have a moderate elasticity, leading to soft and good touch.

Figure 10:
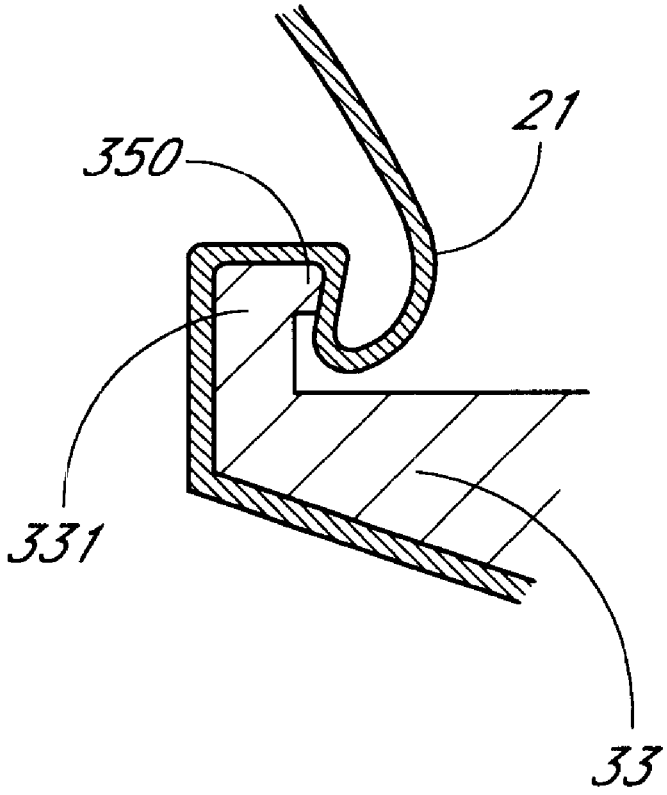
FIG. 10 is a cross section illustrating an example of the end structure in the lower fitting arm of a handle mounted on a plastic bottle with a handle according to this invention.

The handle in this invention, as illustrated in the cross section of the structure of the end of its lower fitting arm of FIG. 10, a protrusion 350 may be further formed at the end of the protruding piece 331 formed at the end of the lower fitting arm 33.

The handle having the protrusion 350 at the end of the protruding piece 331 may be embedded into the wall 21 in the concave formed on the side of the bottle body for mounting the handle, to significantly improve mounting strength of the handle because the protrusion 350 can act as an anchor to the wall 21.

In particular, when the handle is mounted on the bottle body by insert molding, the protruding piece 331 is formed facing upward as illustrated in FIG. 10 to reduce a sliding resistance because of absence of a protrusion in the lower surface of the lower fitting arm 33. The protruding piece 331 can be, therefore, quite smoothly attached to the wall 21 during molding, and the wall 21 enfolding the protruding piece 331 may further enfold the protrusion 350 entering thereunder to act as an anchor to a downward stress for preventing the handle from slipping out, and thus to significantly improve mounting strength.

Figure 11:
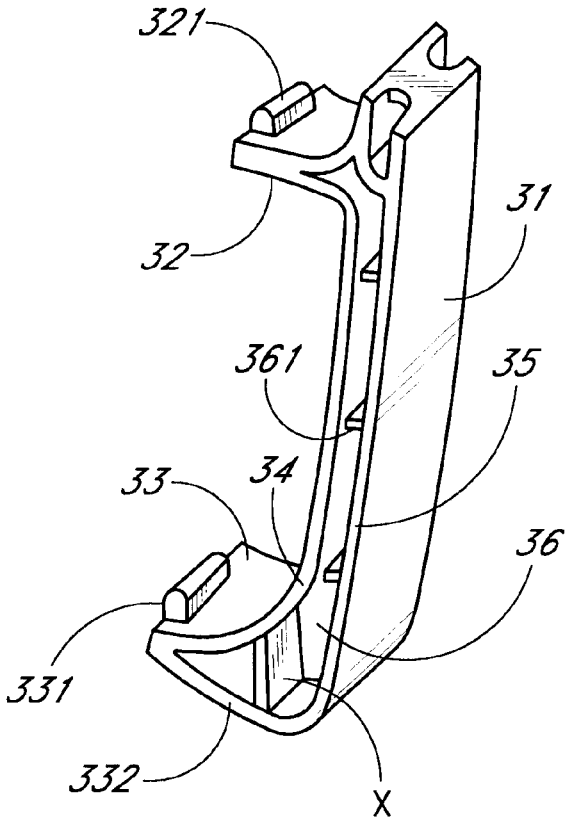
FIG. 11 is a perspective view of an example of a handle mounted on a plastic bottle with a handle according to this invention.

A handle in this invention, as illustrated in its perspective view of FIG. 11, may have an H-shaped lateral cross section from a grip 31 in the handle to its upper and lower fitting arms 32, 33 where an inner plate 34 is interconnected with an outer plate 35 via a central rib 36, and comprises a reinforcing rib. X within a fitting arm 33 below a grip 31, which extends in a lateral direction and interconnects the inner plate 34 with the outer plate 35.

The inner and the outer plates 34, 35 of the grip 31 in the handle 3 are platy, so that their surfaces can be finished to give smooth touch when being grasped.

The H-shaped lateral cross section from the grip 31 in the handle to its upper and lower fitting arms 32, 33 where the inner plate 34 is interconnected with the outer plate 35 via the central rib 36 may allow the overall handle to have a reduced weight maintaining adequate strength, and the grip 31 to have a moderate elasticity, leading to soft and good touch when being grasped. The H-shaped lateral cross section may simplify the structure of an injection-molding mold because the mold may be moved only in the open side during injection molding.

As seen in FIG. 11, interconnecting the inner plate 34 with the outer plate 35 in the handle 3 via a plurality of lateral ribs 361 perpendicular to the central rib 36 and arranged at appropriate intervals may allow the grip 31 to be reinforced without deteriorating its overall light-weight structure.

The inner plate 34, the outer plate 35, the central rib 36 and the lateral ribs 361 preferably have a thickness of 2 to 4 mm to achieve an appropriate balance between the strength and the weight of the handle. The thickness of the reinforcing rib X is preferably about 1 to 4 mm.

Figure 12:
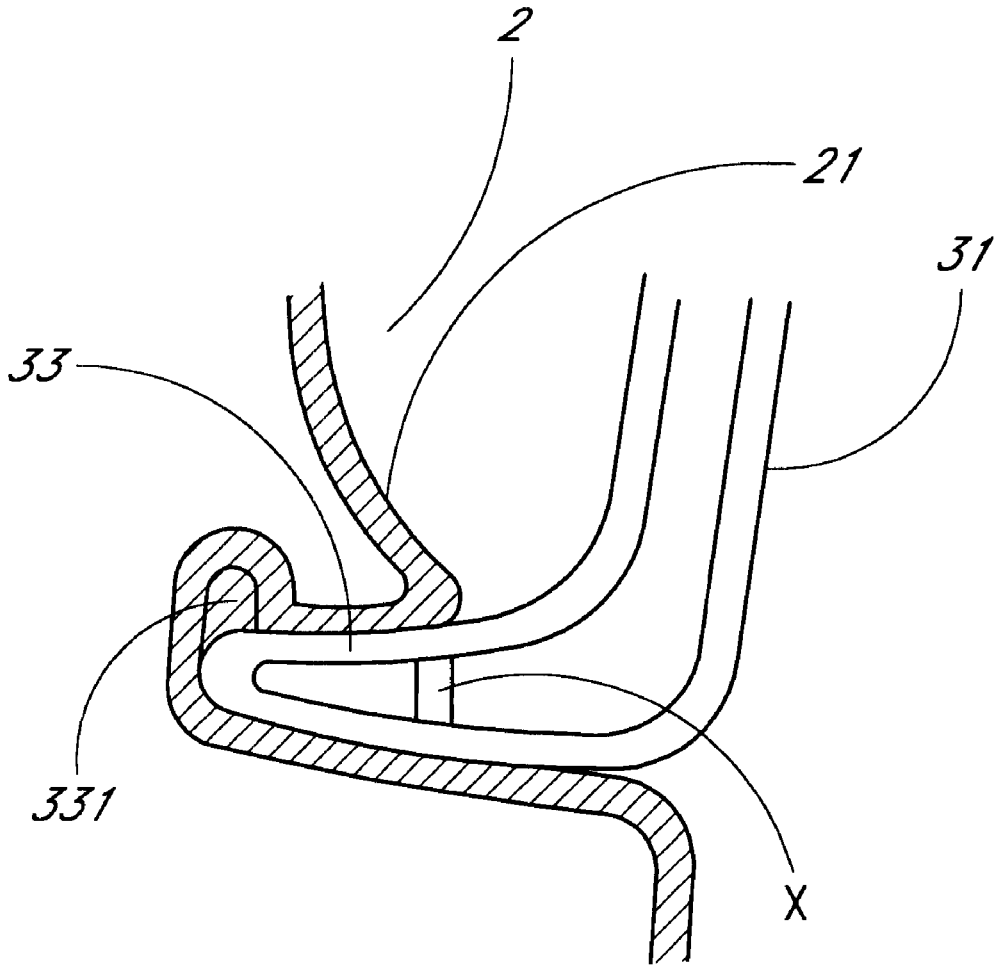
FIG. 12 is a partial cross section illustrating an example of fitting at the end of the lower fitting arm of the handle.

A position of the reinforcing rib X depends on a fitting degree of the protruding piece 331. Specifically, in order to have the handle mounted surely on the bottle body as shown in FIG. 12, when the fitting degree (the distance from the end surface of the lower fitting arm 33 to the grip(31)-side end of the wall concave 21) is determined by putting the wall concave 21 over the upper surface of the lower fitting arm 33, the reinforcing rib X is preferably at the end of the wall concave 21 to give the most effective reinforcement. Since the fitting degree must be at least 10 to 12 mm for enfolding the protruding piece, the reinforcing rib X is positioned as shown in FIG. 12.

Providing the reinforcing rib X may improve the strength of the handle itself, and furthermore, the reinforcing rib X may give rigidity between the inner and the outer plates 34, 35, to be extremely effective in preventing the handle from slipping out.

According to this embodiment, the handle itself may be manufactured to be thinner and lighter to give quite excellent touch when being grasped and to be stronger, as well as may be prevented from slipping out.

Figure 13:
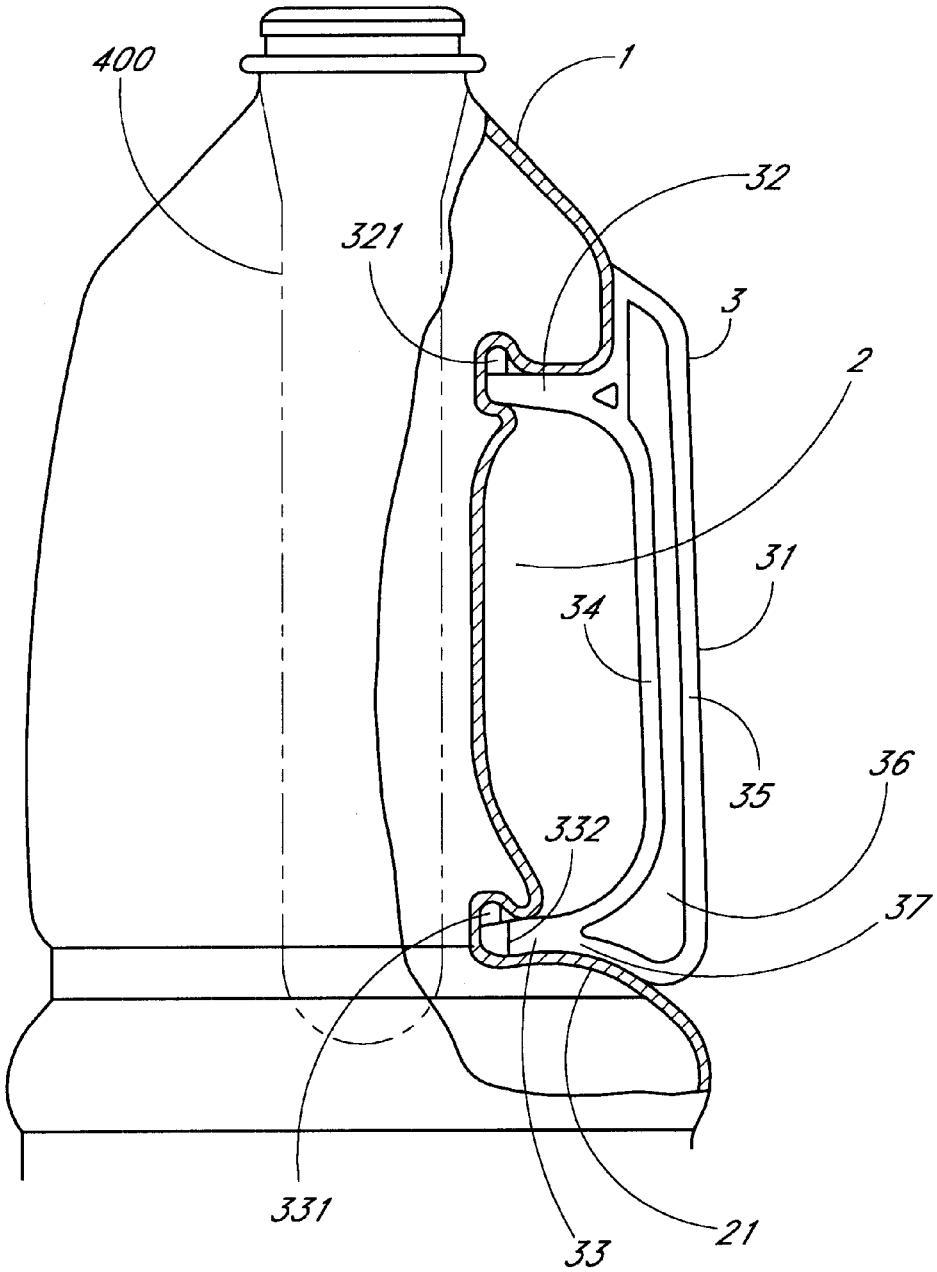
FIG. 13 is a partial front cross section illustrating an embodiment of a plastic bottle with a handle according to this invention.

A handle in this invention, as illustrated in its side view of FIG. 13, may have a configuration where a protruding piece is formed on the upper surface of the end of the lower fitting arm and upward concave fitting parts are formed at both ends of the lower surface of the lower fitting arm.

This embodiment of the plastic bottle with a handle may be manufactured preferably by presetting a handle 3 in a blow mold having a shape corresponding to the outer surface of the bottle 1 as, for example, shown in FIG. 13, in a way that the ends of its fitting arms 32, 33 protrude to the divided inner surfaces; inserting a parison 400 preheated to a molding temperature in the mold; closing the mold; and conducting blow molding by blowing high-pressure air from an inlet of the parison 400 (this process may be combined with longitudinal extension using an unshown extension rod) to forming the bottle body 1 corresponding to the mold while mounting the parison 400 enfolding the protruding pieces 321, 331 and partly the fitting arms 32, 33.

For the concave fitting parts 37 formed at both ends of the lower surface of the lower fitting arm 33 in the handle 3 in this embodiment, the overall lower surface of the lower fitting arm 33 may be formed in advance as a concave fitting part 37 curved by 0.3 to 1.5 mm upward from the horizontal line extended from the lower surface 332 of the end, to suitably fit it with the concave wall 21 of the bottle body 1.

In an alternative aspect of the handle 3, the lower surface of the lower fitting arm 33 in the handle 3 may be a flat surface with a thickness of 0.5 to 2.5 mm to allow the concave fitting part 37 to be easily formed by a pressure from the bottle wall during blow molding which pushes both ends of the lower surface up by about 1.0 to 2.5 mm.

According to this embodiment, the protruding piece 331 is formed on the upper surface of the end of the lower fitting arm 33, which can eliminate necessity of forming a protruding piece on the lower surface. The concave wall 21 may be, therefore, smoothly extended without becoming excessively thin. The concave wall 21 fits the upward concave fitting parts 37 formed at both ends of the lower surface of the lower fitting arm 33, enfolding the protruding piece 331 of the upper surface and the concave part 37 in a manner that they are sandwiched by the wall. Consequently, the handle 3 is firmly mounted on the bottle body 1 and it is quite hard to remove the handle.

The inner and the outer plates 34, 35 of the grip 31 in the handle 3 are platy, so that their surfaces can be finished to give smooth touch when being grasped.

The H-shaped lateral cross section from the grip 31 in the handle 3 to its upper and lower fitting arms 32, 33 where the inner plate 34 is interconnected with the outer plate 35 via the central rib 36 may allow the overall handle 3 to have a reduced weight maintaining adequate strength, and the grip 31 to have a moderate elasticity, leading to soft and good touch when being grasped.

The H-shaped lateral cross section may simplify the structure of an injection-molding mold because the mold may be moved only in the open side during injection molding.

According to this embodiment, the handle itself may be manufactured to be thinner and lighter to give soft and smooth touch. Furthermore, since the concave wall fits the protruding piece on the upper surface and the concave parts at both ends of the lower surface of the end of the lower fitting arm in the handle, the handle may be strongly prevented from slipping out even when an impact is applied to the bottle body or the handle.

Figure 14:
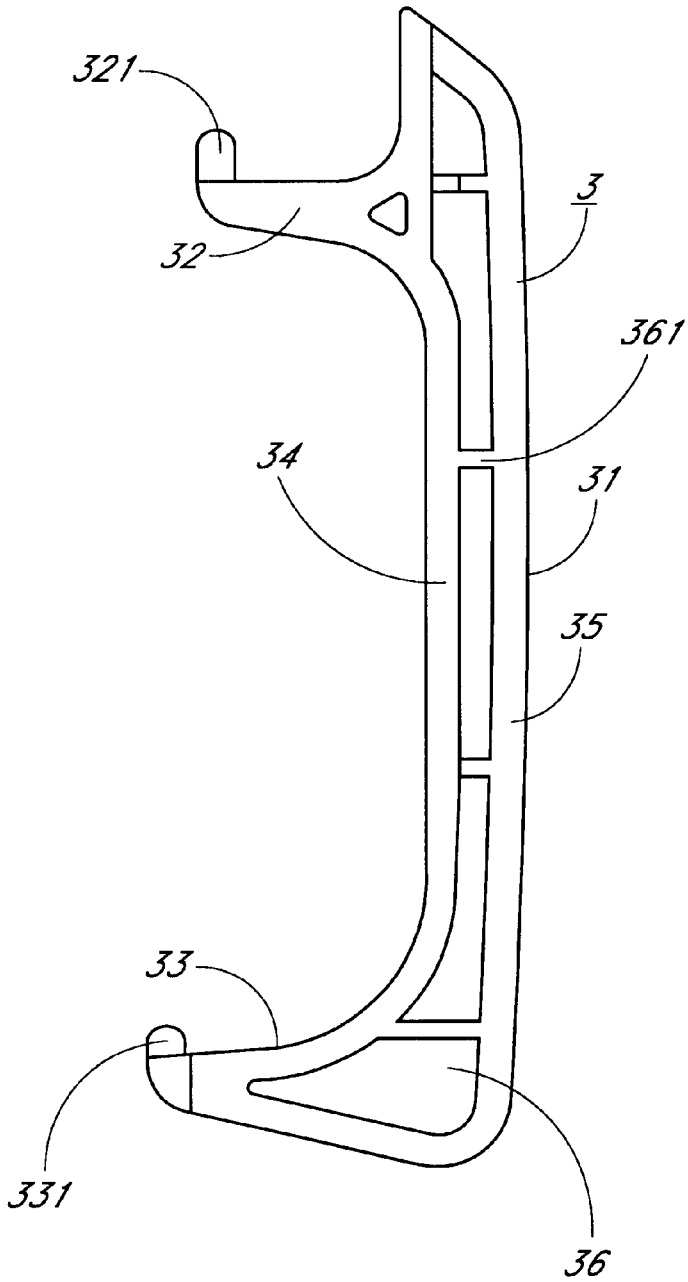
FIG. 14 is a side view of an example of a handle mounted on a plastic bottle with a handle according to this invention.
Figure 15:
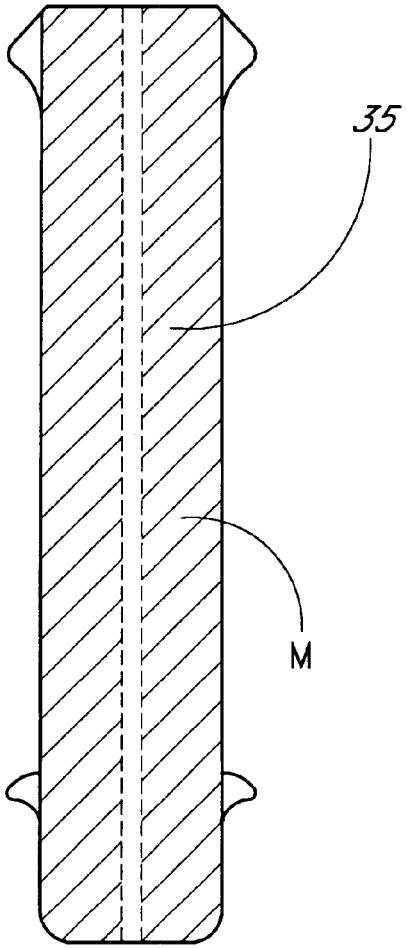
FIG. 15 is a rear elevation of the handle in FIG. 14.

A handle in this invention, as illustrated in its side view of FIG. 14 and in its rear view of FIG. 15, may have an H-shaped lateral cross section from a grip in the handle to its upper and lower fitting arms where an inner plate is interconnected with an outer plate via a central rib, and may comprise a corrugation at least in a part corresponding to the central rib of the outer surface of the outer plate of the grip.

The handle illustrated in FIGS. 14 and 15 has an H-shaped lateral cross section from a grip 31 in the handle 3 to its upper and lower fitting arms 32, 33 where an inner plate 34 is interconnected with an outer plate 35 via a central rib 36, and comprises depressions M at least in a part corresponding to the central rib 36 of the outer surface of the outer plate 35 of the grip 31.

In this embodiment, the handle may be made of a strong polyester resin to make the inner and the outer plates 34, 35 as thin as 1.5 to 2.5 mm and flexible. The H-shaped lateral cross section from the grip 31 in the handle 3 to its upper and lower fitting arms 32, 33 where the inner plate 34 is interconnected with the outer plate 35 via the central rib 36 may allow the overall handle 3 to have a reduced weight maintaining adequate strength, and the grip 31 to have a moderate elasticity, leading to soft and good touch when being grasped.

The H-shaped lateral cross section may simplify the structure of an injection-molding mold because the mold may be moved only in the open side during injection molding.

As illustrated in FIG. 14, interconnecting the inner plate 34 with the outer plate 35 in the handle 3 via a plurality of lateral ribs 361 perpendicular to the central rib 36 and arranged at appropriate intervals may allow the grip 31 to be reinforced without deteriorating its overall light-weight structure.

In this embodiment, the depressions M are formed at least in a part corresponding to the central rib 36 of the outer surface of the outer wall of the grip 31, to allow even a transparent or translucent handle 3 to shield its inside, so that the inner central rib 36 becomes less noticeable, which it very advantageous in terms of its appearance.

Besides letters, the depressions M may give crimps or oblique lines. As shown in FIG. 15, they may be applied the whole outer surface of the outer wall to make the lateral rib 361 less noticeable.

Figure 16:
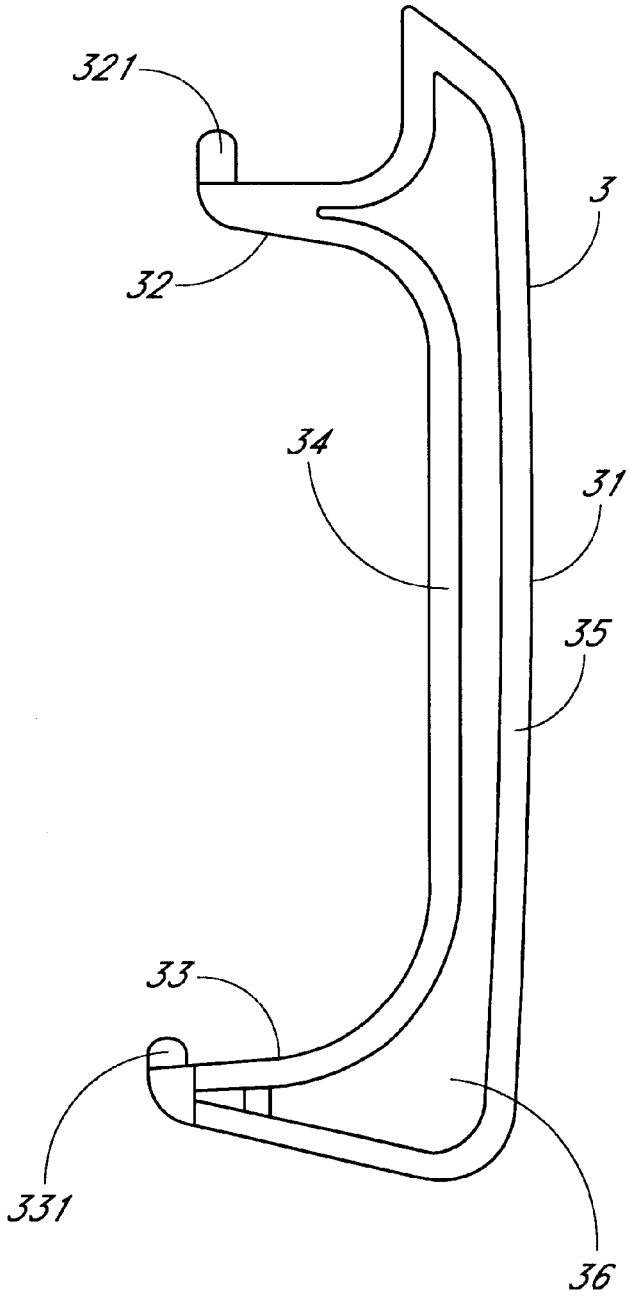
FIG. 16 is a side view of an example of a handle mounted on a plastic bottle with a handle according to this invention.

A handle in this invention, as illustrated in its side view of FIG. 16, may have an H-shaped lateral cross section from a grip in the handle to its upper and lower fitting arms where an inner plate is interconnected with an outer plate via a central rib, and may comprise a central rib, but not lateral ribs, at least in the grip.

The handle illustrated in FIGS. 16 has an H-shaped lateral cross section from a grip 31 in the handle 3 to its upper and lower fitting arms 32, 33 where an inner plate 34 is interconnected with an outer plate 36 via a central rib 36, and comprises a central rib 36, but not lateral ribs perpendicular to the central rib, at least in the grip 31.

In this embodiment, the handle 3 may be made of a strong polyester resin to make the inner and the outer plates 34, 35 constituting the H-shaped lateral cross section as thin as 2.5 mm or less, preferably 1.5 mm or less. Furthermore, it may have adequate strength with no lateral ribs perpendicular to the central rib 36.

The H-shaped lateral cross section where the inner plate 34 is interconnected with the outer plate 35 via the central rib 36 of the grip 31 in the handle 3 may allow the overall handle 3 to have a reduced weight maintaining adequate strength, and the grip 31 to have a moderate elasticity, leading to soft and good touch when being grasped.

Since this embodiment has a H-shaped lateral cross section and does not comprise lateral ribs, there are no crossings of the central rib with a lateral rib. A surface sink may not be, therefore, formed during injection molding. In addition, there are no lateral ribs which are apparently noticeable. The handle is, therefore, simple and quite excellent in its appearance.

The inner and the outer plates 34, 35 of the grip 31 in the handle 3 are platy, so that their surfaces can be finished to give smooth touch when being grasped.

The H-shaped lateral cross section may simplify the structure of an injection-molding mold because the mold may be moved only in the open side during injection molding.

According to this embodiment, the overall handle has a reduced weight maintaining adequate strength, and the grip has a moderate elasticity, leading to soft and good touch when being grasped.

Absence of lateral ribs can eliminate an occurrence of a surface sink during injection molding and give a quite excellent appearance.

Figure 17:
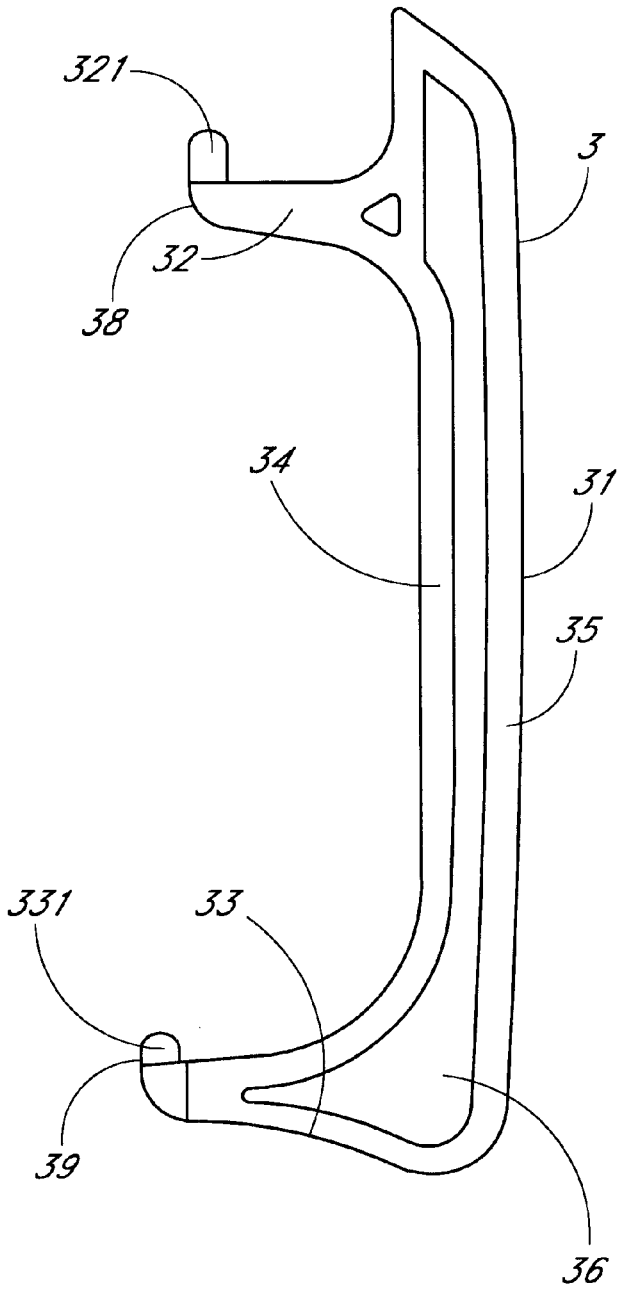
FIG. 17 is a side view of an example of a handle mounted on a plastic bottle with a handle according to this invention.
Figure 18:
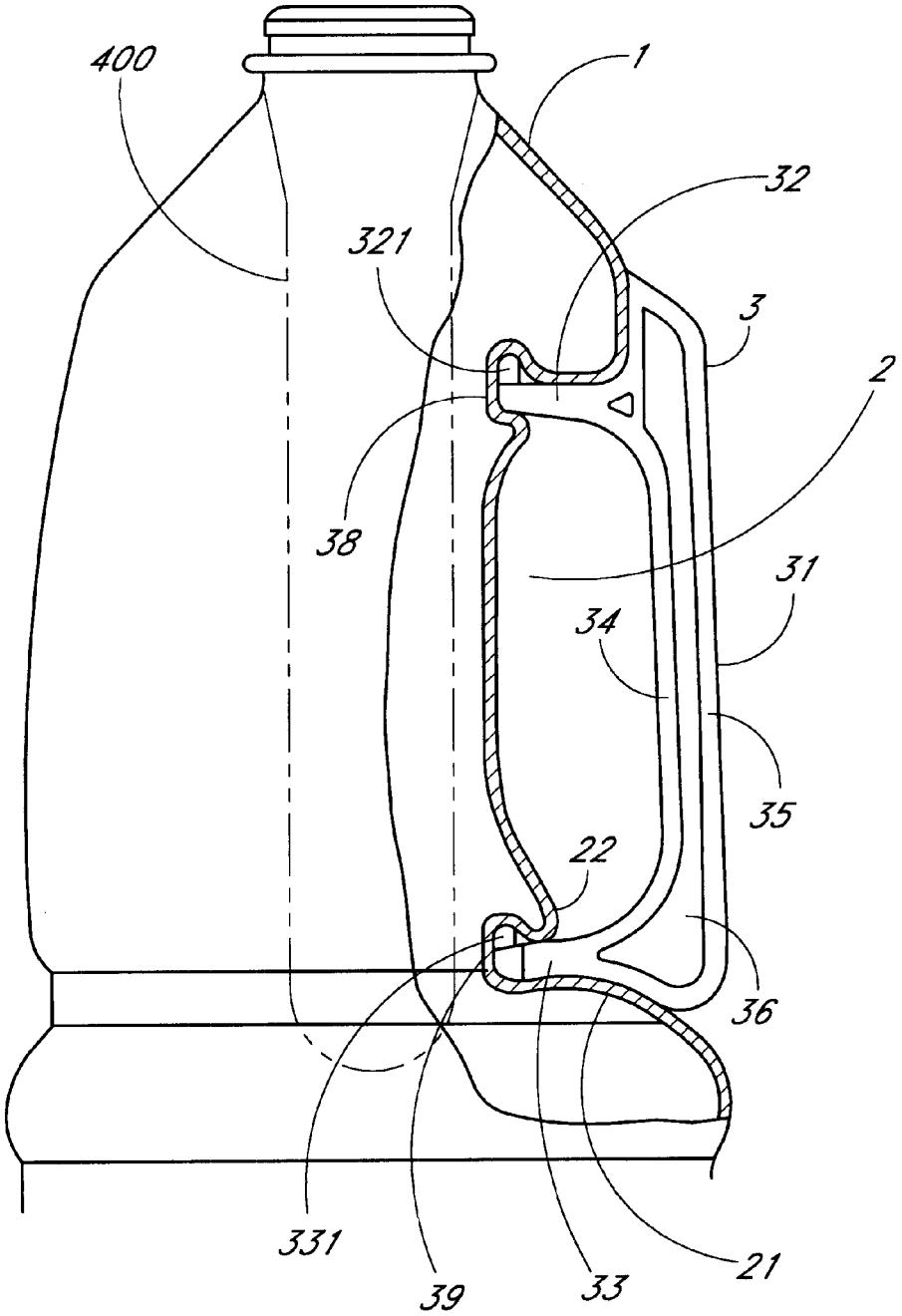
FIG. 18 is a partial front cross section illustrating an embodiment of a plastic bottle with a handle according to this invention.

A handle in this invention, as illustrated in its side view of FIG. 17 and in FIG. 18,where the handle is mounted on a concave for mounting a handle in a bottle body, may have a configuration where the end surface of a lower fitting arm is closer to the bottle outer wall than the end surface of an upper fitting arm.

In this embodiment, the handle 3 to be mounted on the bottle body 1 comprises, as illustrated in FIGS. 17 and 18, a grip 31 and laterally-protruding fitting arms 32, 33 at both upper and lower ends of the grip 31, where protruding pieces 321, 331 are formed on the upper surfaces of the ends of the upper and lower fitting arms 32, 33, respectively, and the end surface 39 of the lower fitting arm is closer to the bottle outer wall than the end surface 38 of the upper fitting arm when the handle 3 is mounted on the concave 2 for mounting a handle in the bottle body 1.

The end surface 39 of the lower fitting arm is desirably closer to the bottle outer wall by 0.5 to 2.0 mm than the end surface 38 of the upper fitting arm. If less than 0.5 mm, the bottle wall 21 in contact with the lower surface of the lower fitting arm 33 tends to be thinner. If more than 2.0 mm, a degree of enfolding of the protruding piece 331 at the end of the upper surface of the lower fitting arm 33 with the bottle wall 22 tends to lessen. Either case is undesirable because of a reduced mounting strength. In other words, the end surface 39 of the lower fitting arm 33 may be placed closer to the bottle outer wall by 0.5 to 2.0 mm than the end surface 38 of the upper fitting arm 32, to distribute in a good balance the bottle wall 21 in contact with the lower surface of the lower fitting arm 33 and the bottle wall 22 enfolding the protruding piece 331. Thus, these walls may fit and may not be thinned, leading to keeping mounting strength.

This embodiment of the plastic bottle with a handle may be manufactured preferably by presetting a handle 3 in a blow mold having a shape corresponding to the outer surface of the bottle I as, for example, shown in FIG. 18, in a way that the ends of its fitting arms 32, 33 protrude to the divided inner surfaces; inserting a parison 400 preheated to a molding temperature in the mold; closing the mold; and conducting blow molding by blowing high-pressure air from an inlet of the parison 400 to forming the bottle body 1 corresponding to the mold while mounting the parison enfolding the protruding pieces 321, 331 and partly the fitting arms 32, 33.

Positioning the end surface 39 of the lower fitting arm 33 closer to the bottle outer wall than the end surface 38 of the upper fitting arm 32 may allow the protruding piece 331 of the lower fitting arm 33 to easily fit the inner part of the concave 2 for mounting a handle and the bottle wall 21 in contact with the lower surface of the lower fitting arm 33 to maintain its thickness and to be prevented from slipping out.

The inner and the outer plates 34, 35 of the grip 31 in the handle 3 are platy, so that their surfaces can be finished to give smooth touch when being grasped.

The H-shaped lateral cross section from the grip 31 in the handle 3 to its upper and lower fitting arms 32, 33 where the inner plate 34 is interconnected with the outer plate 35 via the central rib 36 may allow the overall handle 3 to have a reduced weight maintaining adequate strength, and the grip 31 to have a moderate elasticity, leading to soft and good touch when being grasped.

The H-shaped lateral cross section may simplify the structure of an injection-molding mold because the mold may be moved only in the open side during injection molding.

According to this embodiment, the handle itself may be manufactured to be thinner and lighter to give soft and smooth touch when being grasped. Furthermore, since the concave wall in the bottle body fits the protruding piece at the end of the lower fitting arm in the handle, the handle may be strongly prevented from slipping out even when an impact is applied to the bottle body or the handle.

Figure 19A:
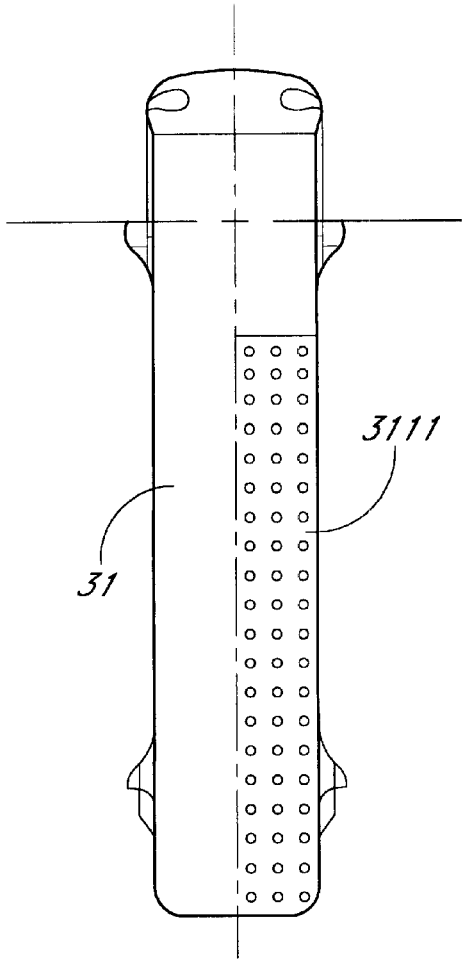
FIG. 19(*a*) is a rear elevation illustrating an example of a handle mounted on a plastic bottle with a handle according to this invention, and FIG. 19(*b*) is a side view of the handle in FIG. 19(*a*).
Figure 19B:
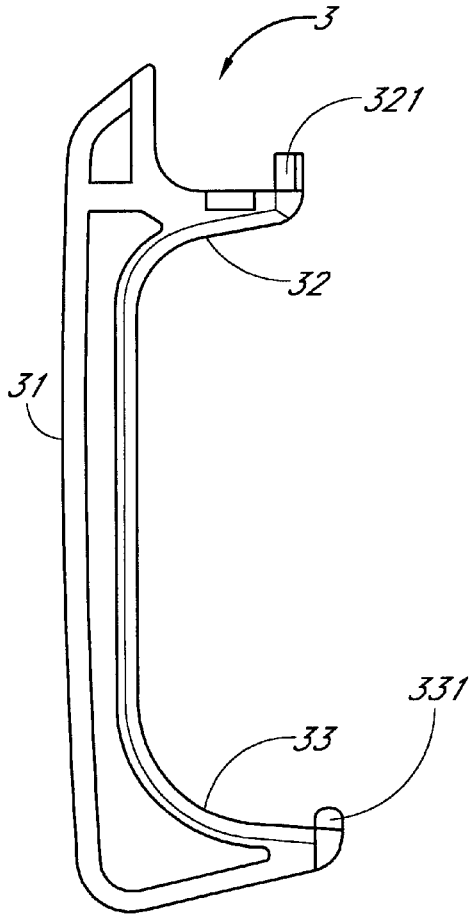

A handle in this invention, as illustrated in its rear view of FIG. 19(*a*), may have a configuration where a display using depressions is provided in a half outer surface from the center line of the grip in the handle.

According to this embodiment, the depressions are formed on the half outer surface from the center line of the grip in the handle, i.e., the handle can play a role of display.

In this embodiment, a handle may be made of, for example, a polyester resin represented by polyethylene terephthalate, polypropylene or polyethylene. In particular, it is preferable to prepare the handle from a polyester resin as is for the bottle body because it may allow the handle to be processed for recycle together with the body and also to be made of a recycled resin.

As illustrated in FIG. 19(*a*), the display 3111 is provided by depressions in the half outer surface from the center line of the grip 31 in the handle. The grip may feel less rough than one in which the display 3111 is provided on its both halves. Unpleasant feeling on grasping the handle or the bottle with a handle may be, therefore, reduced.

When many handles must be aligned in the same direction in a process of carrying or mounting the handles, the display 3111 by depressions on a half surface may provide a visually and optically asymmetrical appearance to facilitate recognition of the direction.

The handle may be manufactured using an injection-molding mold consisting of a sliding and a fixed forms which can be divided from the part corresponding to the center of the handle. In the process, it is preferable to form the display 3111 by depressions on a half surface of the fixed form because a half surface having a higher friction resistance may stably remain in the fixed form owing to the display 3111 by depressions when separating the forms after molding of the handle.

The handle can be removed from the fixed cast with an ejection pin, without being affected by a large friction resistance.

Since the display 3111 is provided by depressions, it may be effective using either transparent and colorless or translucent material.

Figure 20:
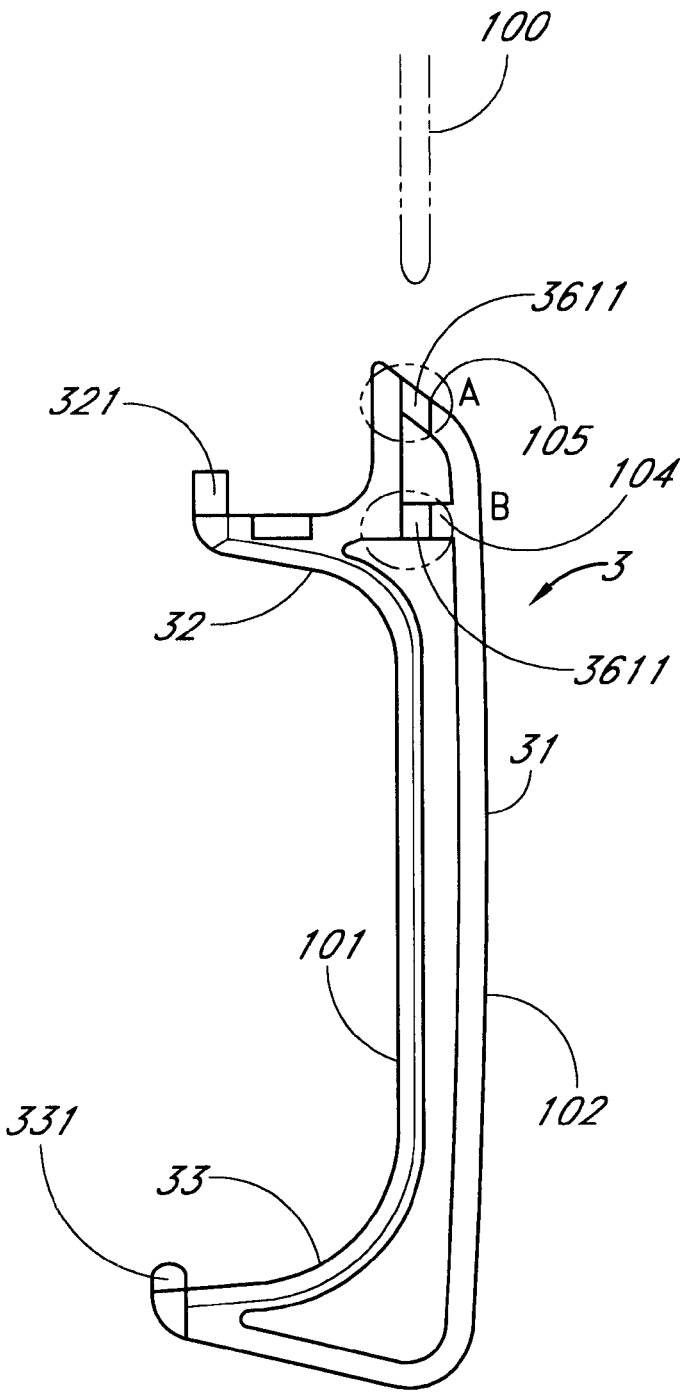
FIG. 20 is a side view of an example of a handle mounted on a plastic bottle with a handle according to this invention.

A handle of this invention, as illustrated in its side view in FIG. 20, may have an H-shaped lateral cross section in its grip where an inner plate is interconnected with an outer plate via a central rib, and may have a configuration where a notch is formed on the top wall of the grip, there are provided lateral ribs at intervals below the top wall which interconnect the inner plate to the outer plate, and a notch is formed on the side of the lateral rib, wherein the above notches are aligned in a line.

This embodiment has an H-shaped lateral cross section in the grip of the handle where an inner plate is interconnected with an outer plate via a central rib, and has a configuration where there are provided a plurality of lateral ribs at intervals at one end of the grip which interconnect the inner plate to the outer plate, and notches are formed on the sides of the individual lateral ribs wherein the notches are aligned in a line. Thus the plurality of notches aligned at intervals may stably support the handle on inserting a carrying pin, so that the handle or the plastic bottle with a handle after inserting a carrying pin can be stably carried without significantly losing its lightness.

This embodiment will be described with reference to FIG. 20. The embodiment has an H-shaped lateral cross section in the grip 31 of the handle 3 where an inner plate 101 is interconnected with an outer plate 102 via a central rib, and has a configuration where a notch 3611 is formed on the top wall 105 of the grip 31, there are provided lateral ribs 104 at intervals below the top wall 105 which interconnect the inner plate 101 to the outer plate 102, and a notch 3611 is formed on the side of the lateral rib 104, wherein the above notches 3611 are aligned in a line. Thus, after a carrying pin 100 is inserted along the aligned notches 3611, two separate points support the pin to more stably fix the pin. More lateral ribs 104 may be herein provided to give three or more notches 3611 which contribute to supporting the carrying pin 100. The handle 3 may be manufactured using an injection-molding mold consisting of a sliding and a fixed forms which can be divided from the part corresponding to the center of the handle. This embodiment is preferable in this process because the handle 3 has an H-shaped lateral cross section in its grip 31 where an inner plate 101 is interconnected with an outer plate 102 via a central rib, and has a configuration where notches 3611 are formed on the top wall 105 and on the side of the lateral rib 104, wherein the above notches 3611 are aligned in a line and thus these notches 3611 are aligned to the direction of dividing the forms or removing a product so that it does not hinder dividing the forms or removing a product.

According to this embodiment, the plurality of notches aligned at intervals may stably support the inserted carrying pin. The handle or the plastic bottle with a handle may be, therefore, stably carried after inserting the carrying pin without significantly losing its lightness.

Figure 21:
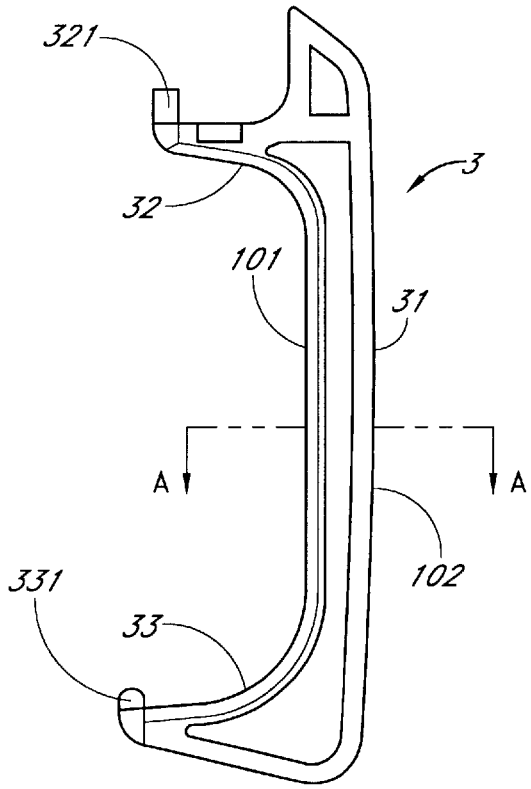
FIG. 21 is a side view of an example of a handle mounted on a plastic bottle with a handle according to this invention.
Figure 22:
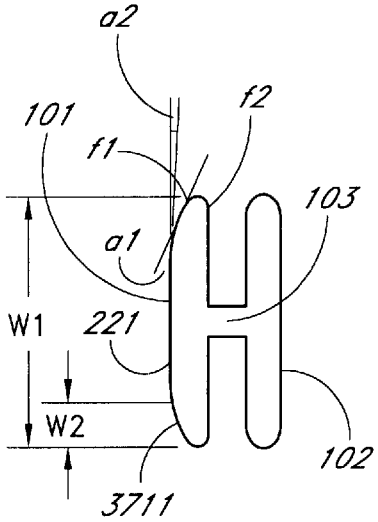
FIG. 22 is a cross section taken on line A—A of FIG. 21.

A handle in this invention, as illustrated in its side view in FIG. 21 and in FIG. 22 which is a cross section taken on line A—A in FIG. 21, may have an H-shaped lateral cross section in the grip of the handle where an inner plate is interconnected with an outer plate via a central rib, and may have a configuration where chamfers are formed in both sides of the inner surface of the inner plate to improve its gripping touch.

This embodiment has an H-shaped lateral cross section in the grip of the handle where an inner plate is interconnected with an outer plate via a central rib, and has a configuration where chamfers are formed in both sides of the inner surface of the inner plate to improve its gripping touch. In combination with the relatively flexible and soft H-shaped lateral cross section, the chamfers may improve its gripping touch and make the handle more comfortable.

With reference to FIGS. 21 and 22, this embodiment provides a handle 3 comprising a grip 31 and fitting arms 32, 33 laterally extended from the upper and the lower ends of the grip 31, characterized in that the handle 3 has an H-shaped lateral cross section in its grip 31 where an inner plate 101 is interconnected with an outer plate 102 via a central rib 103, and has a configuration where chamfers 3711 are formed in both sides of the inner surface of the inner plate 101 to improve its gripping touch.

This embodiment has an H-shaped lateral cross section in the grip 31 of the handle 3 where an inner plate 101 is interconnected with an outer plate 102 via a central rib 103, and has a configuration where chamfers 3711 are formed in both sides of the inner surface of the inner plate 101 to improve its gripping touch. The inner surface of the inner plate 101 has a curvature giving good touch to a finger in contact with the plate, leading to comfortable feeling. A lateral cross section of the chamfers 3711, as shown in FIG. 22, preferably has a width w2 equal to 25% of the width w1 of the inner plate 101 and an angle $\alpha 1$ of 15 to 30°, and has inner and outer ends finished to be curved surfaces w1 and f2, respectively.

The inner surface may be finished in two steps to have a slope 221 with an angle $\alpha 2$ of 1 to 50 from its center to the inner edge of the chamfer 3711 and the slope of the chamfer 3711, to further improve its touch and feeling.

The handle 3 may be manufactured using an injection-molding mold consisting of a sliding and a fixed forms which can be divided from the part corresponding to the center of the handle 3. This embodiment is preferable in this process because the handle 3 has an H-shaped lateral cross section in its grip 31 where an inner plate 101 is interconnected with an outer plate 102 via a central rib 103, and has a configuration where chamfers 3711 are formed in both sides of the inner surface of the inner plate 101 in a manner that the chamfers 3711 gradually become thinner along the direction of dividing the forms or removing a product so that they do not hinder dividing the forms or removing a product.

Figure 23:
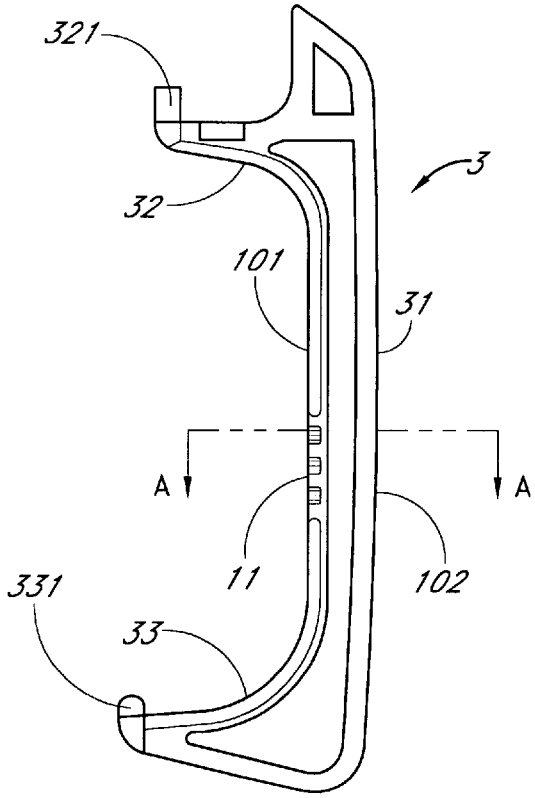
FIG. 23 is a side view of an example of a handle mounted on a plastic bottle with a handle according to this invention.
Figure 24:
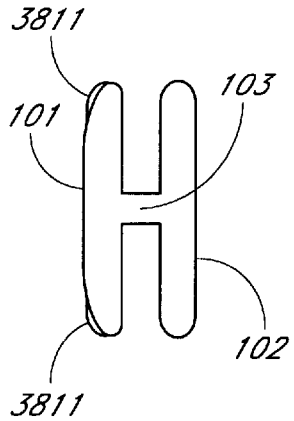
FIG. 24 is a cross section taken on line A—A of FIG. 23.

A handle in this invention, as illustrated in its side view in FIG. 23 and in FIG. 24 which is a cross section taken on line A—A in FIG. 23, may have an H-shaped lateral cross section in the>grip of the handle where an inner plate is interconnected with an outer plate via a central rib, and may have a configuration where non-slip depressions are formed only near both edges in one or both of the inner and the outer plates.

This embodiment is characterized in that it has an H-shaped lateral cross section in the grip of the handle where an inner plate is interconnected with an outer plate via a central rib, and has a configuration where anti-slipping depressions are formed only near both edges in one or both of the inner and the outer plates. Thus, in combination with the relatively flexible H-shaped lateral cross section, the depressions formed near both edges may give delicate softness. and have an anti-slipping effect without losing its overall touch owing to the smooth central region.

With reference to FIGS. 23 and 24, this embodiment provides a handle 3 comprising a grip 31 and fitting arms 32, 33 laterally extended from the upper and the lower ends of the grip 31, characterized in that the handle 3 has an H-shaped lateral cross section in its grip 31 where an inner plate 101 is interconnected with an outer plate 102 via a central rib 103, and has a configuration where anti-slipping depressions 3811 are formed only near both edges in one or both of the inner and the outer plates 101, 102.

This embodiment has an H-shaped lateral cross section in its grip 31 where an inner plate 101 is interconnected with an outer plate 102 via a central rib 103, and has a configuration where anti-slipping depressions 3811 are formed only near both edges in the inner plate 101, as shown in FIGS. 23 and 24. Thus, in combination with the relatively flexible H-shaped lateral cross section, the depressions 3811 formed near both edges may give delicate softness to the inner and/or outer plates 101, 102 and have an anti-slipping effect without losing its overall touch because most of the central region except the regions around the edges is smoothly finished.

Depressions 3811 may be, but not shown, formed near both edges of the outer plate 102 or both of the outer and the inner plates 101, 102.

The handle 3 may be manufactured using an injection-molding mold consisting of a sliding and a fixed forms which can be divided from the part corresponding to the center of the handle 3. This embodiment is preferable in this process because/he handle 3 has an H-shaped lateral cross section in its grip 31 where an inner plate 101 is interconnected with an outer plate 102 via a central rib 103, and has a configuration where anti-slipping depressions 3811 are formed only near both edges in one or both of the inner and the outer plates 101, 102 in a manner that the anti-slipping depressions 3811 are parallel to the direction of dividing the forms or removing a product and are unlikely to be undercut so that they do not hinder dividing the forms or removing a product.

Figure 25A:
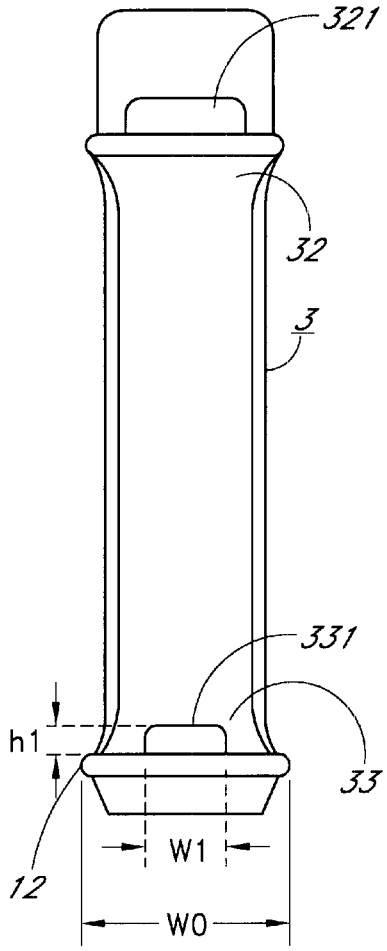
FIG. 25(*a*), FIG. 25(*b*) and FIG. 25(*c*) show an example of a handle mounted on a plastic bottle with a handle according to this invention.
Figure 25B:
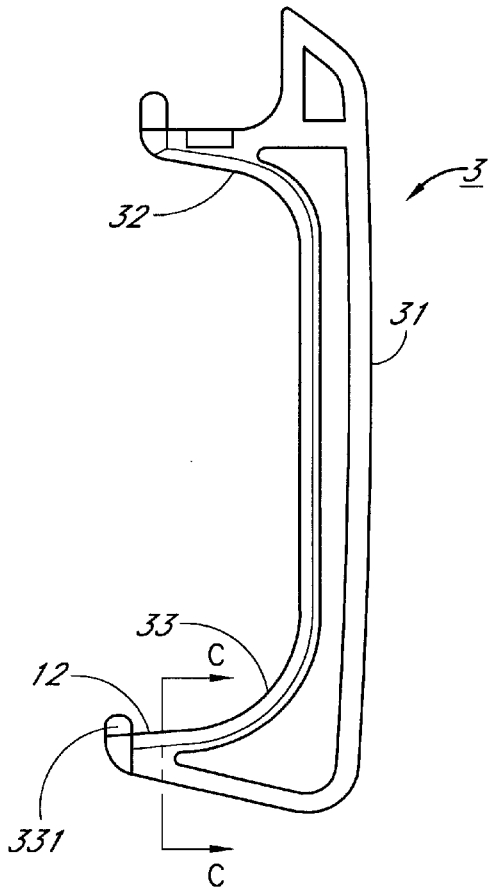
Figure 25C:
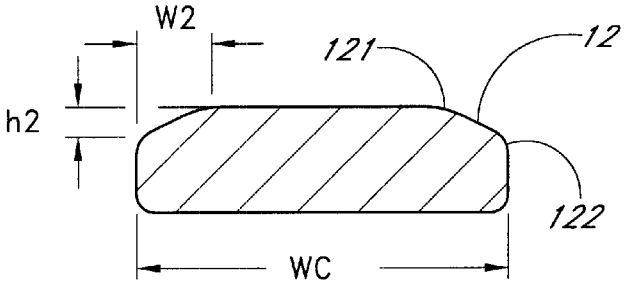

A handle in this invention, as illustrated in its front view of FIG. 25(*a*), its side view of FIG. 25(*b*) and its cross section FIG. 25(*c*) taken on line C—C in FIG. 25(*b*), may have a configuration where there is formed a protruding piece narrower than the lower fitting arm on the upper side of the end in the lower fitting arm and both edges of the upper surface of the lower fitting arm are chamfered.

According to this embodiment, there is provided a handle having a configuration where there is formed a protruding piece narrower than the lower fitting arm on the upper side of the end in its lower fitting arm and both edges of the upper surface of the lower fitting arm are chamfered. Thus, during assembling the bottle body and the handle while blow-molding the bottle body, it becomes easier for the bottle wall to enfold the handle as the protruding piece is narrower. Furthermore, when the bottle wall whose edge is significantly extended reach both edges of the upper surface of the lower fitting arm, the chamfered edges may avoid a sharp stress to prevent the extended wall from being broken and the upward protruding piece may prevent the handle from slipping out when an upward force is applied in a normal handling.

This embodiment will be further described with reference to FIG. 25. As illustrated in FIG. 25, there is provided a handle 3 comprising a grip 31 and fitting arms 32, 33 laterally extended from the upper and the lower ends of the grip 31, where there is formed a protruding piece 331 narrower than the lower fitting arm 33 on the upper side of the end in its lower fitting arm 33 and both edges of the upper surface of the lower fitting arm 33 are chamfered (12).

The handle 3 according to this embodiment may have any shape, as long as it has a basic configuration as illustrated in FIG. 25, comprising a grip 31 and fitting arms 32, 33 laterally extended from the upper and the lower ends of the grip 31, where there is formed a protruding piece 331 narrower than the lower fitting arm 33 on the upper side of the end in its lower fitting arm 33 and both edges of the upper surface of the lower fitting arm 33 are chamfered (12). The width w1 of the protruding piece 331 is preferably about 30% to 70% of the width w0 of the end of the lower fitting arm 33. The width w0 of the end of the lower fitting arm 33 is generally 20 to 30 mm, and the height h1 and the width w1 of the protruding piece 331 are preferably 2 to 5 mm and 5 to 15 mm, respectively. If the height h1 is less than 2 mm or the width w1 is less than 5 mm, the piece may be insufficiently engaged with the bottle wall to effectively prevent slipping out. If the height h1 is more than 5 mm or the width w1 is more than 15 mm, the bottle wall may inadequately enfold the protruding piece 331, so that a space may be formed between the wall and the upper surface of the lower fitting arm 33 to give an unpleasant appearance or slipping out may not be effectively prevented. The above limits are, therefore, preferable.

Considering the area of the protruding piece 331 enfolded by and in contact with the bottle wall, the chamfer 12 is preferably formed within 15 mm from the end of the lower fitting arm 33. The chamfer may be preferably, in, e.g., its cross section taken on line C—C, a slope where the ratio of width (w2)/height (h2) is about 2 (an angle to a horizontal plane is 20 to 30°) and whose ends 121, 122 are curved.

The width w2 of the chamfer 12 is preferably about 5 to 15% of the width wc of the handle. An unshown small corrugation such as a crimp, crape, lattice or groove pattern may be formed on the surface of the protruding piece 331 in contact with the bottle body or the lower surface of the lower fitting arm 33 to improve slipperiness.

The small corrugation may have a height of 0.05 to 1.0 mm, preferably 0.05 to 0.5 mm.

The small corrugation may be provided by molding the handle using an injection-molding mold in which a corresponding small corrugation has been formed or by sandblasting or cutting a handle after molding.

Figure 26A:
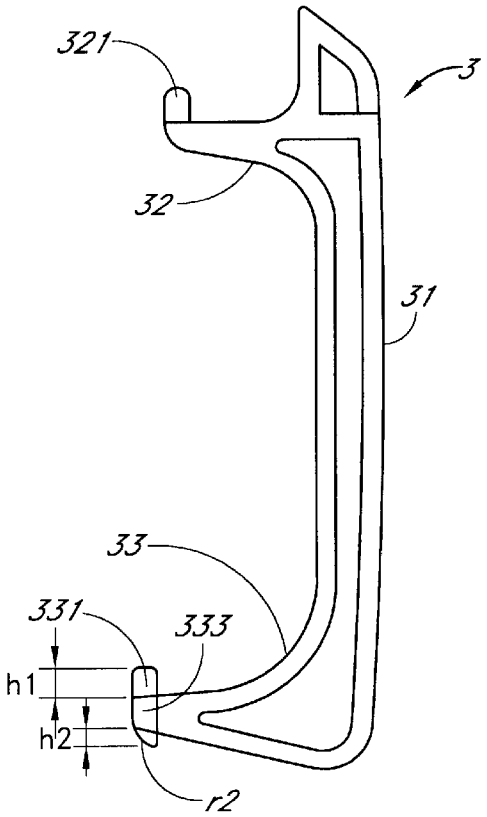
FIG. 26(*a*), FIG. 26(*b*) and FIG. 26(*c*) show an example of a handle mounted on a plastic bottle with a handle according to this invention.
Figure 26B:
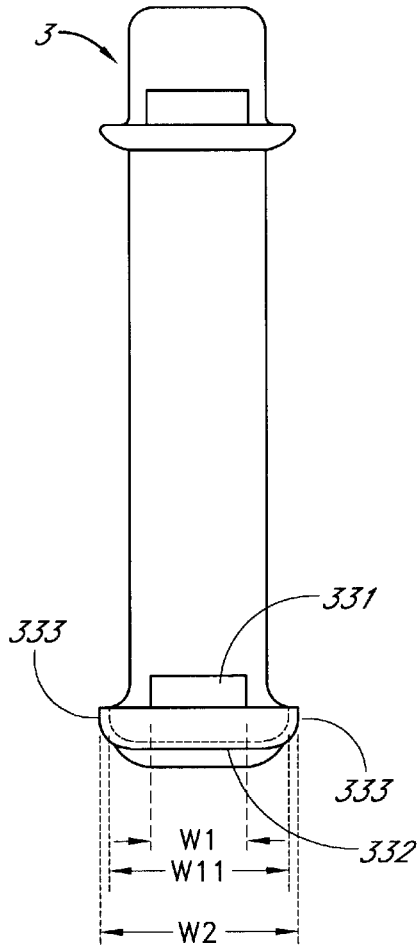
Figure 26C:
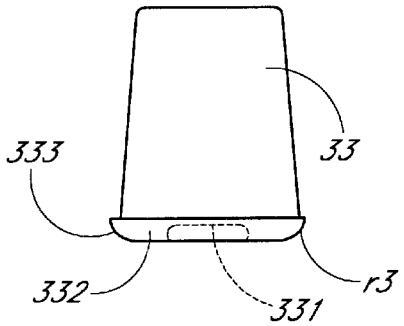

A handle in this invention, as illustrated in its side, front and bottom views of FIG. 26(*a*), FIG. 26(*b*) and FIG. 26(*c*), may have a configuration where a protruding piece is formed on the upper side of the end of the lower fitting arm while a downward hook under the protruding piece is formed on the lower side.

The handle of this embodiment has a configuration where a protruding piece is formed on the upper side of the end of the lower fitting arm in the handle while a downward hook which is lower than the protruding piece is formed on the lower side. Thus, during assembling the bottle body and the handle while blow-molding the bottle body, the bottle wall and the lower side of the end of the lower fitting arm in the handle may be smoothly extended because of their relatively small friction owing to the lower downward hook, and the bottle wall may adequately enfold the upper protruding piece, maintaining an adequate thickness in the region outer from the end of the lower fitting arm, so that a stronger upward force may more firmly engage the handle with the bottle wall to improve mounting strength in combination with an anchor effect of the downward hook.

This embodiment will be further described with reference to FIG. 26. As illustrated in FIG. 26, there is provided a handle 3 comprising a grip 31 and fitting arms 32, 33 laterally extended from the upper and the lower ends of the grip 31, where a protruding piece 331 is formed on the upper side of the end of the lower fitting arm 33 while a downward hook 332 under the protruding piece is formed on the lower side.

The handle 3 according to this embodiment may have any shape, as long as it has a basic configuration as illustrated in FIG. 26, comprising a grip 31 and fitting arms 32, 33 laterally extended from the upper and the lower ends of the grip 31, where a protruding piece 331 is formed on the upper side of the end of the lower fitting arm 33 while a downward hook 332 under the protruding piece is formed on the lower side.

The height h1 and the width w1 of the protruding piece 331 are preferably 2 to 5 mm and 5 to 20 mm, respectively. If the height h1 is less than 2 mm or the width w1 is less than 5 mm, the piece may be insufficiently engaged with the bottle wall to effectively prevent slipping out. If the height h1 is more than 5 mm or the width w1 is more than 15 mm, the bottle wall may inadequately enfold the protruding piece 331, so that a space may be formed between the wall and the lower fitting arm 33 to give an unpleasant appearance or slipping out may not be effectively prevented. The above limits are, therefore, preferable.

The height h2 of the downward hook 332 is less than the height hi of the protruding piece 331 to reduce a friction resistance. Preferably, h2 is 60% or less of the height h1 of the protruding piece 331 and 1 to 2 mm.

If the height h2 of the downward hook 332 is less than 1 mm, a hooking effect is inadequate to satisfactorily improve mounting strength. If it is more than 60% of the height h1 of the protruding piece 331 or 2 mm, the bottle wall near the outer side of the lower surface of the concave for mounting a handle may become thinner. Thus, the above limits are preferable.

The width w2 of the downward hook 332 may be as large as 15 mm or more to improve its anchor effect.

As illustrated in FIG. 26(*a*) and FIG. 26(*c*), the downward hook 332 may have a width w2 larger than the width w11 of the end of the lower fitting arm 33 to be integrated with the lateral hook 333, not only to further improve its anchor effect, but also to make the shape from the lower surface to the side smoother, leading to reducing a friction resistance during molding and maintaining its effect of preventing the bottle wall from being thinned.

The front surfaces of the downward and the lateral hooks 332,and 333 may have radii of curvature r2, r3 of 2 to 5 mm, to reduce a resistance.

An unshown small corrugation such as a crimp, crape, lattice or groove pattern may be formed on the surface of the protruding piece 331 or the downward hook 332 in contact with the bottle body or the lower surface of the lower fitting arm 33 to improve slipperiness.

The small corrugation may have a height of 0.05 to 1.0 mm, preferably 0.05 to 0.5 mm.

The small corrugation may be provided by molding the handle using an injection-molding mold in which a corresponding small corrugation has been formed or by sandblasting or cutting a handle after molding.

Figure 27A:
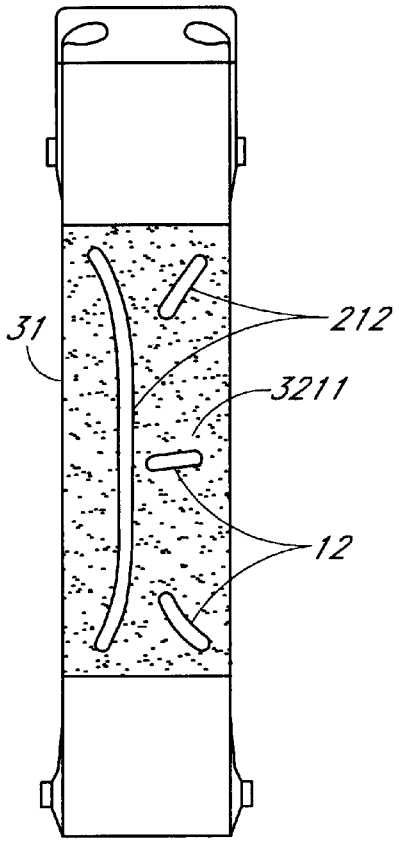
FIG. 27(*a*) and FIG. 27(*b*) show an example of a handle mounted on a plastic bottle with a handle according to this invention.
Figure 27B:
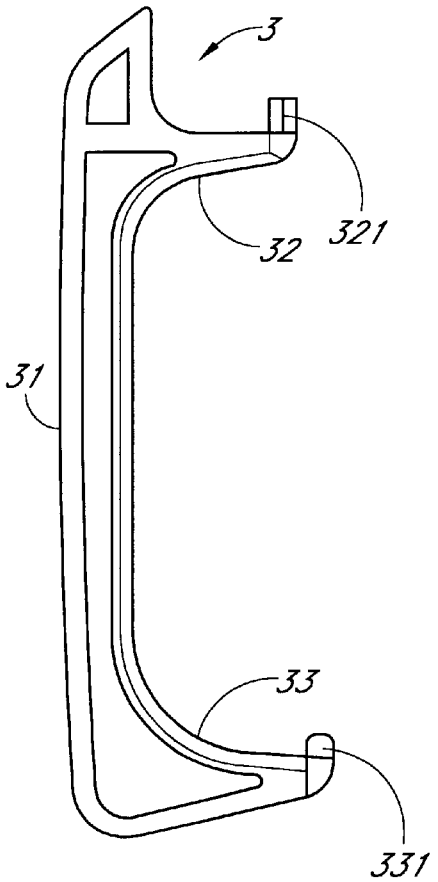

A handle in this invention, as illustrated in its front and side views of FIG. 27(*a*) and FIG. 27(*b*), may comprise a display as a plain pattern in a basic pattern consisting of fine depressions in the outer surface of the grip in the handle.

According to this embodiment, there is provided a handle comprising a display as a plain pattern in a basic pattern consisting of fine depressions in the outer surface of the grip in the handle. Thus, the handle can play a role of display, and the display may be more distinct than a display formed by protruding or depressing displaying areas and further may reduce unpleasant sensation on grasping.

This embodiment will be further described with reference to FIG. 27. As illustrated in FIG. 27, there is provided a handle 3 comprising a grip 31 and fitting arms 32, 33 laterally extended from the upper and the lower ends of the grip 31, and comprising a display 212 as a plain pattern in a basic pattern 3211 consisting of fine depressions in the outer surface of the grip 31 in the handle 3.

According to this embodiment, the display 212 as a plain pattern in a basic pattern 3211 consisting of fine depressions in the outer surface of the grip 31 in the handle 3 may be more distinct than a display formed by protruding or depressing displaying areas and further may reduce unpleasant sensation on grasping.

The handle 3 may be manufactured using an injection-molding mold consisting of a sliding and a fixed forms which can be divided from the part corresponding to the center of the handle 3. This embodiment is preferable in this process because the handle 3 comprises a display 212 as a plain pattern in a basic pattern 3211 consisting of fine depressions in the outer surface of the grip 31 in the handle 3 and the friction resistance of the base pattern consisting of fine depressions is relatively constant when the forms are divided after molding the handle 3, to stably divide the forms and remove a product.

In this embodiment, since the display 212 is provided as a plain pattern in the basic pattern 3211 consisting of fine depressions such as a crape pattern, it may play a role of a display even when it is colorless and transparent or translucent.

Figure 28A:
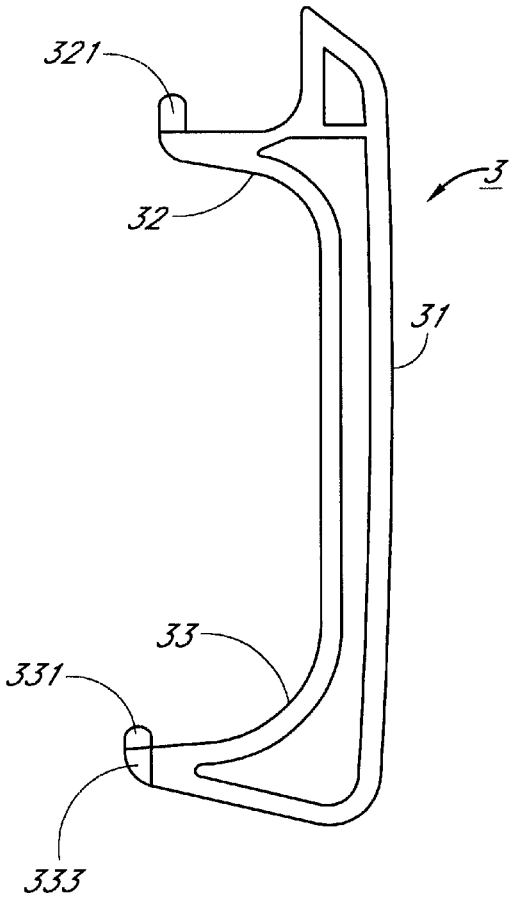
FIG. 28(*a*) and FIG. 28(*b*) show an example of a handle mounted on a plastic bottle with a handle according to this invention.
Figure 28B:
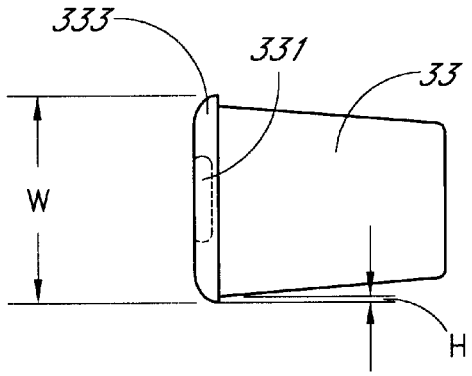

A handle in this invention, as illustrated in its side view of FIG. 28(*a*) and its enlarged bottom view of FIG. 28(*b*), may have a configuration where a lateral hook is formed at the end of the lower fitting arm, the overall width of the lateral hook is 20 to 30% of the maximum diameter of the plastic bottle and the height of the lateral hook is 3 to 6% of the overall width of the lateral hook.

In this embodiment, the width of the lateral hook is 20 to 30% of the maximum diameter of the plastic bottle and the height of the lateral hook is 3 to 6% of the overall width of the lateral hook, so that mounting strength of the handle can be improved.

This embodiment will be further described with reference to FIG. 28. As illustrated in FIG. 28, there is provided a handle 3 where a lateral hook 333 is formed at the end of the lower fitting arm 33, the overall width W of the lateral hook is 20 to 30% of the maximum diameter of the plastic bottle and the height H of the lateral hook is 3 to 6% of the overall width W of the lateral hook.

There are formed upward protruding pieces 321, 331 at the ends of the fitting arms 32, 33, respectively.

For example, in a 1.8 L plastic bottle with a handle, the maximum diameter of the bottle body is about 100 mm and thus, the lateral hook 333 has an overall width W of 20 to 30 mm and a height H of 0.8 to 1.2 mm.

Figure 29A:
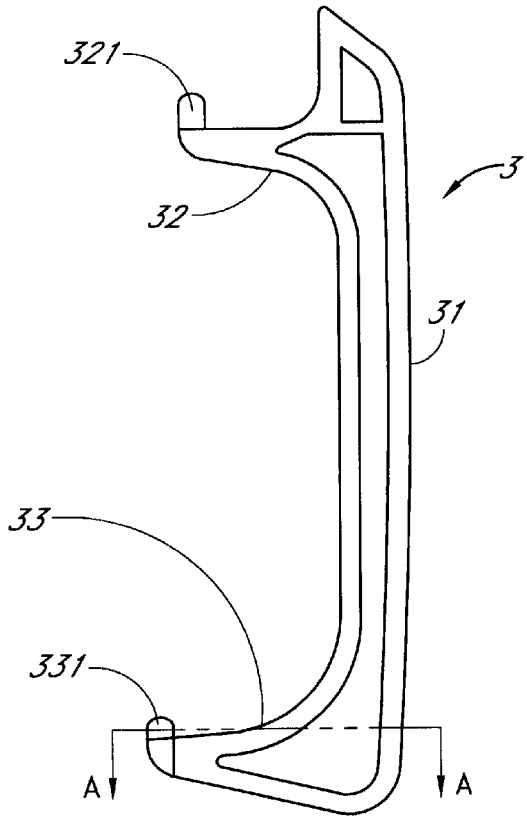
FIG. 29(*a*) and FIG. 29(*b*) show an example of a handle mounted on a plastic bottle with a handle according to this invention.
Figure 29B:
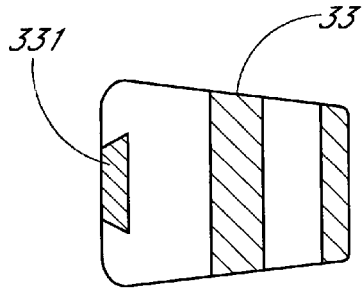

A handle in this invention, as illustrated in its side view of FIG. 29(*a*) and FIG. 29(*b*) which is a cross section taken on line A—A in FIG. 29(*a*), may have a configuration where the lateral cross section of the protruding piece formed on the upper side of the end of the lower fitting arm is a trapezoid which is tapered toward the end of the fitting arm.

According to this embodiment, there is provided a handle where the lateral cross section of the protruding piece upward protruding at the end of the lower fitting arm is a trapezoid which is tapered toward the end of the fitting arm, so that during insert molding, the bottle wall can easily enfold the protruding piece along both walls of the piece, and the bottle wall, once enfolding the piece, is engaged with the rear wall corresponding to the bottom of the trapezoid of the protruding piece to be prevented from slipping out owing to its anchor effect, to improve mounting strength of the handle.

This embodiment will be further described with reference to FIG. 29. As illustrated in FIG. 29, there is provided a handle comprising a grip 31 and fitting arms 32, 33 laterally extended from the upper and the lower ends of the grip 31, where the lateral cross section of the protruding piece 331 upward protruding at the end of the lower fitting arm 33 is a trapezoid which is tapered toward the end of the fitting arm.

There is formed the protruding piece 331 upward protruding at the end of the lower fitting arm 33, whose lateral cross section is a trapezoid which is tapered toward the end of the fitting arm as shown in FIG. 29(*b*).

Figure 30A:
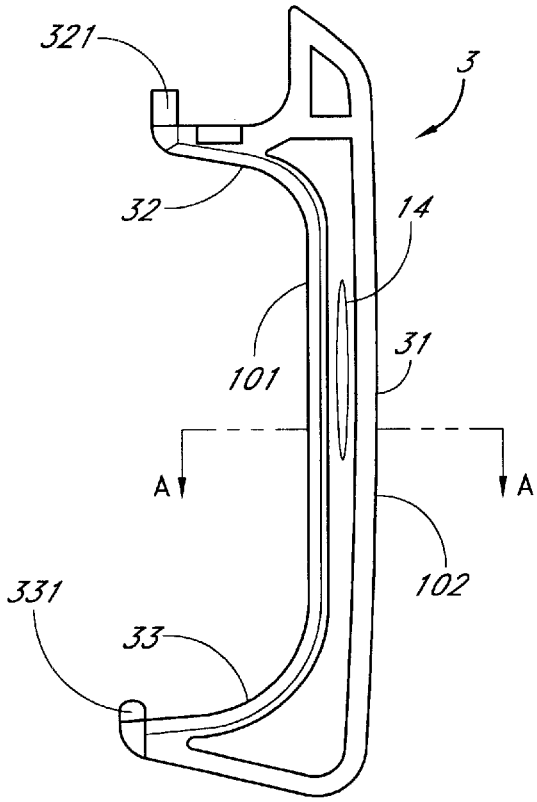
FIG. 30(*a*) and FIG. 30(*b*) shows an example of a handle mounted on a plastic bottle with a handle according to this invention.
Figure 30B:
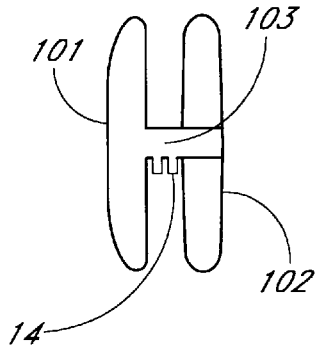

A handle in this invention, as illustrated in its side view of FIG. 30(*a*) and FIG. 30(*b*) which is a cross section taken on line A—A in FIG. 30(*a*), may have an H-shaped lateral cross section in the grip of the handle where an inner plate is interconnected with an outer plate via a central rib, and may have a display on the side of the central rib.

According to this embodiment, a handle has an H-shaped lateral cross section in its grip of the handle where an inner plate is interconnected with an outer plate via a central rib, and has a display on the side surface of the central rib. Thus, it may play a role of a display and the display is, in contrast with a display formed on the side surface of the outer plate, invisible from the front side of the handle, not to influence the appearance of the handle . while giving a required display and may not give unpleasant touch when the display is formed by depressions because it is not in contact with a finger when being grasped.

This embodiment will be further described with reference to FIG. 30. As illustrated in FIG. 30, there is provided a handle 3 comprising a grip 31 and fitting arms 32, 33 laterally extended from the upper and the lower ends of the grip 31, characterized in that the handle 3 has an H-shaped lateral cross section in its grip 31 where an inner plate 101 is interconnected with an outer plate 102 via a central rib 103, and has a display 14 on the side surface of the central rib 103.

The handle 3 has an H-shaped lateral cross section in its grip 31 where an inner plate 101 is interconnected with an outer plate 102 via a central rib 103, and has a display 14 on the side surface of the central rib 103, so that it can, in contrast with a display formed on the side surface of the outer plate 102, give a required display 14 while not influencing the appearance of the handle, and may not give unpleasant touch when the display is formed by depressions because it is not in contact with a finger when being grasped.

The handle 3 may be manufactured using an injection-molding mold consisting of a sliding and a fixed casts which can be divided from the part corresponding to the center of the handle 3. This embodiment is preferable in this process because the handle 3 has an H-shaped lateral cross section in its grip 31 where an inner plate 101 is interconnected with an outer plate 102 via a central rib 103, and has a display 14 on the side surface of the central rib 103, so that when the display 14 is formed by depressions, the depressions are parallel to the direction of dividing the casts or removing a product and thus do not hinder dividing the casts or removing a product.

Since a display 14 consisting of depressions may eliminate the necessity of light and shade or coloring, even a colorless and transparent or translucent handle 3 may satisfactorily play a role of a display.

Figure 31:
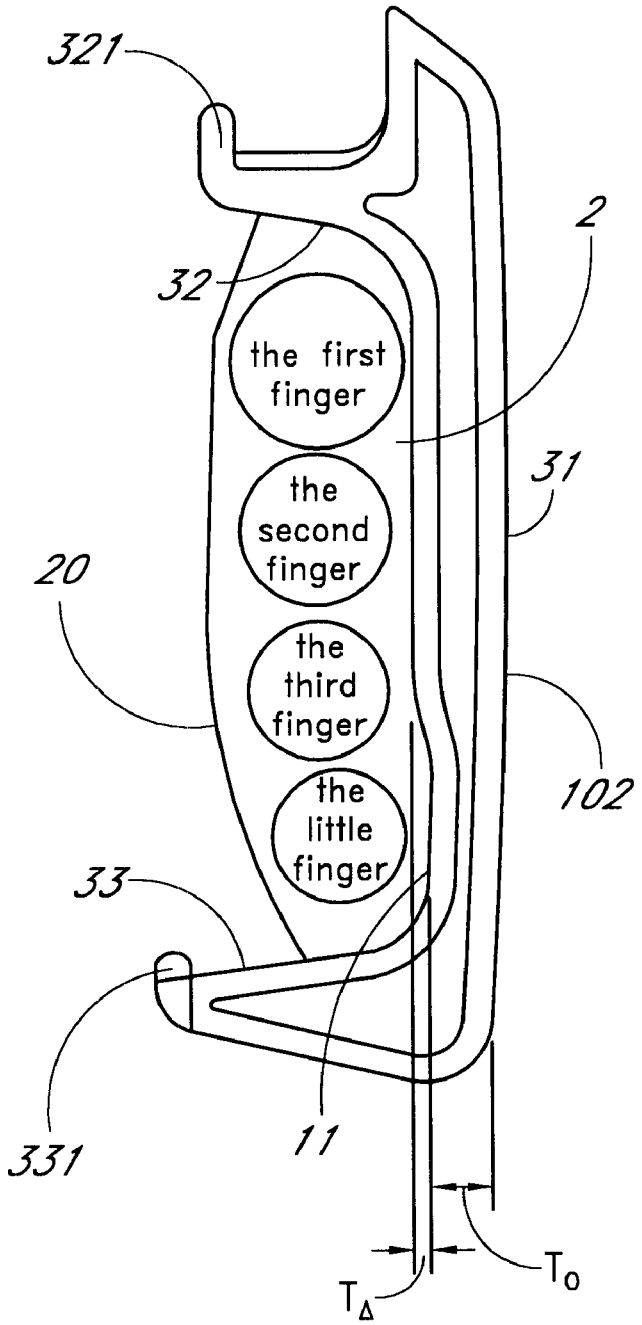
FIG. 31 is a side view illustrating an example of a handle mounted on a plastic bottle with a handle according to this invention.

A handle in this invention, as illustrated in its side view in FIG. 31, may comprise a grip and fitting arms laterally extended from the upper and the lower ends of the grip, and may have a configuration where a concave is formed in the lower part of the inside of the grip by thinning the grip.

According to this embodiment, there is formed a concave in the lower part of the inside of the grip by thinning the grip while the outer side of the grip is still flat, so that it may be firmly grasped and the distance between the grip, and the inner wall of the concave for mounting a handle becomes larger so that the little finger may be slightly moved backward to make a space for fingers wider.

This embodiment will be further described with reference to FIG. 31. As illustrated in FIG. 31, there is provided a handle 3 comprising a grip 31 and fitting arms 32, 33 laterally extended from the upper and the lower ends of the grip 31, where a concave 3411 is formed in the lower part of the inside of the grip 31 by thinning the grip 31.

The lower part of the inside of the grip 31 may be the part where among the four fingers from the forefinger to the little finger which is to be in contact with the inside of the grip 31 on grasping, the little finger may be positioned; generally the part from the bottom to one third of the overall height of the inside of the grip 31.

The thickness T0 of the grip 31 is generally about 6 to 10 mm in the upper part. In the lower part, the grip may be thinner by a difference T Δ of about 0.5 to 2 mm than the thickness T0 to form the concave 3411.

Since the concave 3411 is formed inside of the grip 31 by thinning it, the outer side of the grip 31 is not influenced and still flat.

Since the protruding piece 331 formed at the end of the lower fitting arm 33 protrudes upward, the amount of the inner wall 20 must be increased for enfolding the protruding piece 331, leading to the narrower space for fingers. The concave 3411 may be, therefore, significantly effective.

Figure 32A:
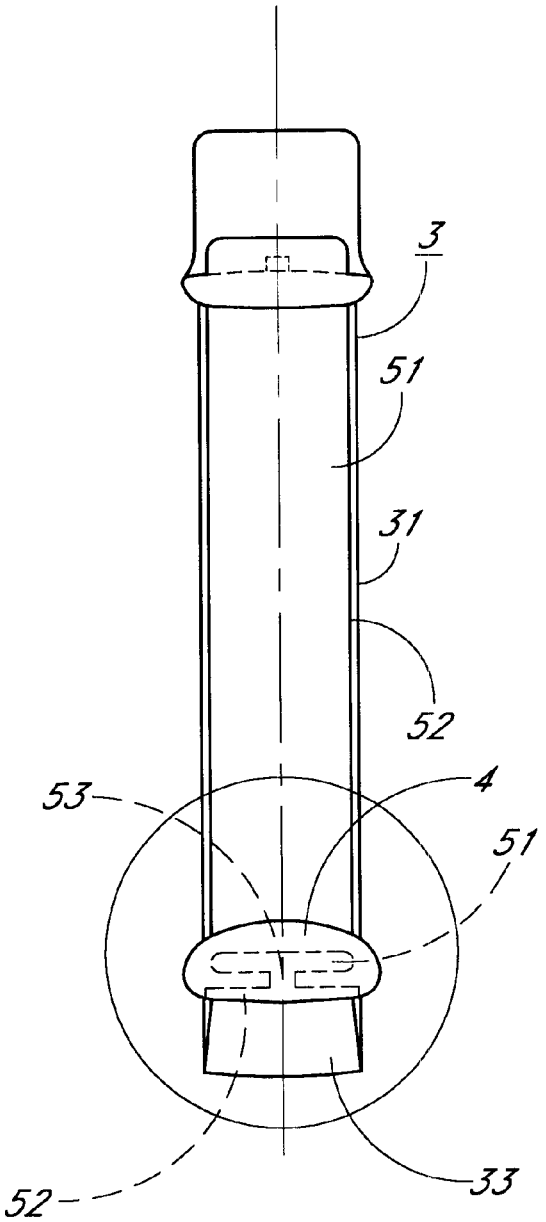
FIG. 32(*a*) and FIG. 32(*b*) shows an example of a handle mounted on a plastic bottle with a handle according to this invention.
Figure 32B:
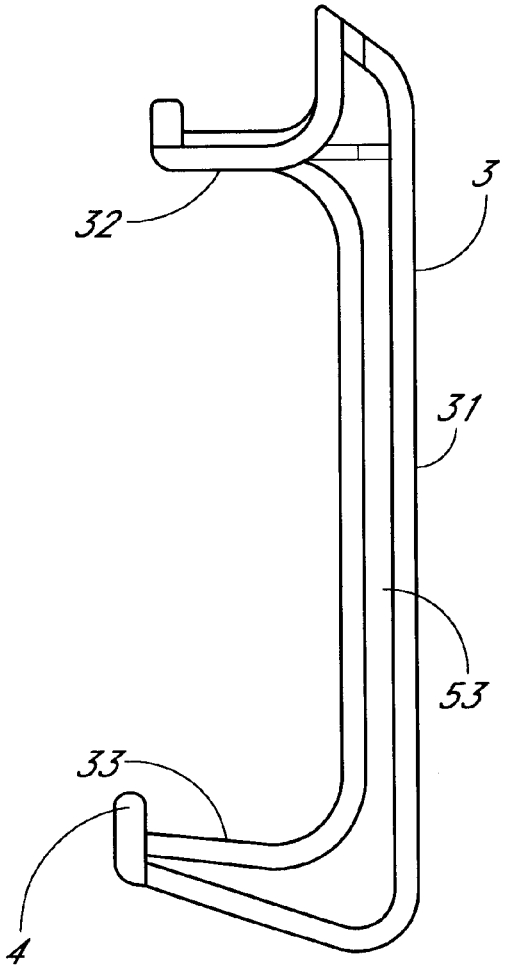
Figure 33:
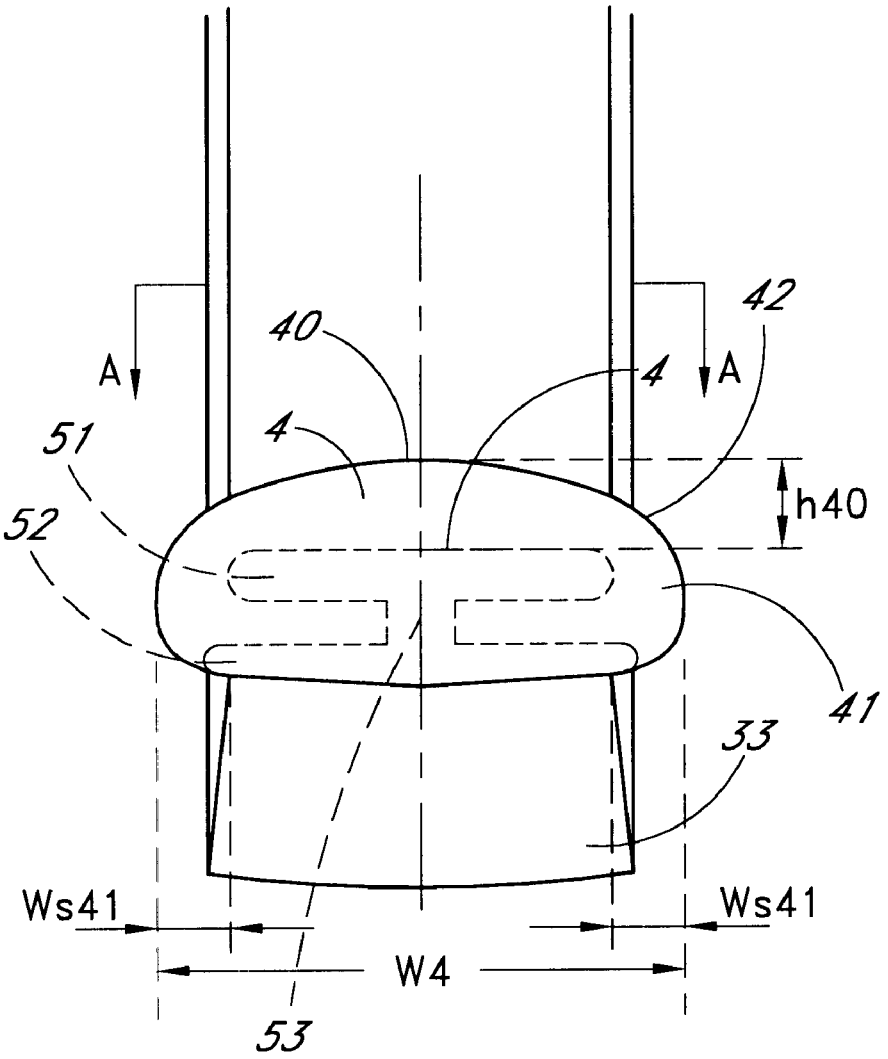
FIG. 33 is an enlarged front view near the lower fitting arm in FIG. 32.
Figure 34:
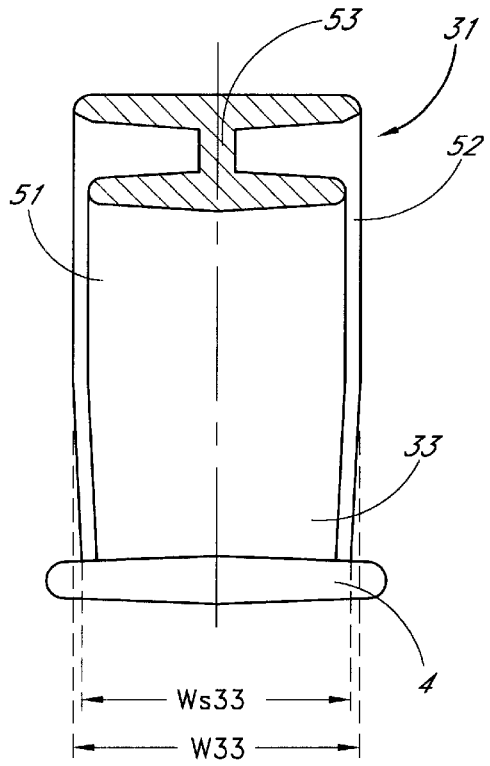
FIG. 34 is a cross section taken on line A—A of FIG. 33.
Figure 35:
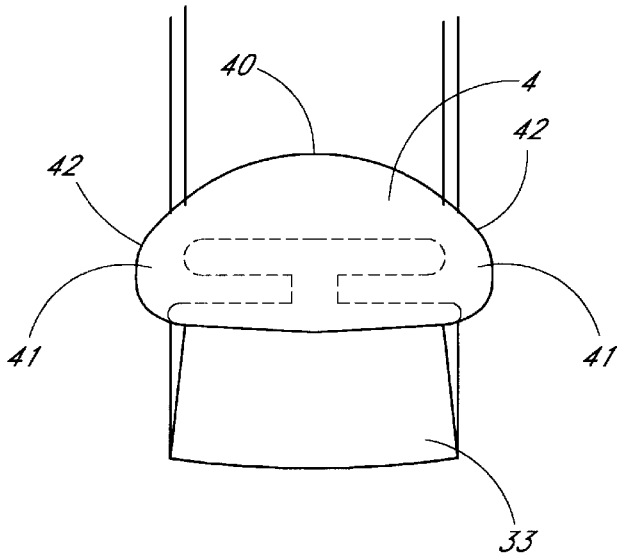
FIG. 35 is an enlarged front view near the lower fitting arm illustrating another example of FIG. 32.

A handle in this invention, as illustrated in its front view in FIG. 32(*a*), its side view in FIG. 32(*b*), FIG. 33 which is an enlarged front view of the region near the lower fitting arm in FIG. 32, FIG. 34 which is a cross section taken on line A—A in FIG. 33 and FIG. 35 which is an enlarged front view of the region near the lower fitting arm in another aspect of FIG. 32, may comprise a grip and fitting arms laterally extended from the upper and the lower ends of the grip, and may have a configuration where a brim continuously protrudes from the upper side of the end of the lower fitting arm to both sides and there is not formed a protrusion in the lower side of the end of the lower fitting arm.

According to this embodiment, a brim continuously protrudes from the upper side of the end of the lower fitting arm to both sides, so that during assembling the bottle body and the handle by blow-molding the body, the bottle wall can smoothly move along the continuously protruding brim to enfold the handle. Furthermore, because of absence of a protrusion in the lower side of the end of the lower fitting arm, the bottle wall and the surface of the lower side of the end of the lower fitting arm are smoothly extended outward with a relatively small friction and thus the bottle wall can maintain an adequate thickness even in a region near the outer side.

This embodiment will be further described with reference to FIGS. 32 to 35. As illustrated in FIGS. 32 to 35, there is provided a handle 3 comprising a grip 31 and fitting arms 32, 33 laterally extended from the upper and the lower ends of the grip 31, where a brim 4 continuously protrudes from the upper side of the end of the lower fitting arm 33 to both sides and there is not formed a protrusion in the lower side of the end of the lower fitting arm 33.

The handle according to this embodiment may have any shape, as long as it has a basic configuration as illustrated in FIGS. 32 to 35, where a brim 4 continuously protrudes from the upper side of the end of the lower fitting arm 33 to both sides and there is not formed a protrusion in the lower side of the end of the lower fitting arm 33. It is, however, preferable that the height $h_{40}$ of the upper side 40 of the brim 4 is 2 to 5 mm, the protrusion width Ws41 of the bilateral protrusions 41 of the brim 4 is 0.5 to 3 mm, and the overall width W4 of the brim 4, although it depends on the size of the bottle, is 20 to 30 mm.

The brim 4 in the handle of this embodiment may be a chamfered trapezoid as shown in the front view in FIG. 33, in which there is formed a large chamfer 42 in the upper side toward both sides where the upper side 40 is gradually declined from the highest center toward the bilateral protrusions 41; a substantially triangle rice ball shape as shown in the front view in FIG. 35 in which a larger chamfer 42 is formed; or a chamfered rectangle (not shown). The chamfered trapezoid in FIG. 33 or the substantially triangle shape in FIG. 35, in which a chamfer 42 is formed, may be preferable because the bottle wall can more smoothly move along the large chamfer 42 of the brim to enfold the handle.

If the height h40 of the upper side is less than 2 mm or the protrusion width Ws41 of the bilateral protrusions is less than 0.5 mm, the brim may be insufficiently engaged with the bottle wall to effectively prevent slipping out. If the height h40 of the upper side is more than 5 mm or the protrusion width Ws41 of the bilateral protrusions is more than 3 mm, the bottle wall may inadequately enfold the brim 4, so that a space may be formed between the wall and the upper surface or both sides of the lower fitting arm 33 to give an unpleasant appearance. The above limits are, therefore, preferable.

For the grip 31 and the fitting arms 32, 33 laterally protruding from the upper and the lower ends of the grip 31, the handle of this embodiment may have an H-shaped cross section as illustrated in FIG. 34, in which an inner plate 51 is interconnected with an outer plate 52 via a central vertical rib 53, to make the handle adequately strong while being light.

For the lower fitting arm 33 in the handle of this embodiment, the width W33 in the grip side is preferably larger than the end width Ws33 as illustrated in FIG. 34 because a vertical stress applied from the grip 31 can be dispersed in a large area of the bottle wall under the lower fitting arm 33 and thus buckling distortion may be prevented.

In the handle of this embodiment, the end of the lower fitting arm 33 preferably has an H-shaped cross section (the cross section vertical to the longitudinal direction) as illustrated in FIGS. 32 to 35 to a position near the end face (the position 3 mm under the end face), in which an inner plate 51 is interconnected with an outer plate 52 via a central vertical rib 53. That is because attempting adequate strength without an H-shaped structure, the cross section must be relatively thick and such a thick end may tend to cause a concave (sometimes referred to as a "surface sink") particularly in the end face due to shrinkage during a cooling process in injection-molding of the handle. On the other hand, a strong H-shaped structure may reduce the thickness, preventing such a noticeable surface sink.

The handle 3 may be generally manufactured using an injection-molding mold consisting of a sliding and a fixed casts (not shown) which can be divided from the part corresponding to the center of the handle 3. It may be advantageous that the grip 31 or the lower fitting arm 33 has an H-shaped lateral cross section (the cross section vertical to the longitudinal direction) where an inner plate 51 is interconnected with an outer plate 52 via a central rib 53 because it may not form an undercut to be a resistance in the direction of dividing the casts or removing a product handle and thus may facilitate dividing the casts to remove a product handle.

In the bottle with a handle according to this embodiment, the continuously protruding brim is smooth, so that during assembling the bottle body and the handle by blow-molding the body, the bottle wall can smoothly move along the bilateral protrusions 41 from the upper side 40 of the brim 4 to enfold the handle. Furthermore, the bottle wall can be advantageously wrapped to the back side of the bilateral protrusions 41 of the brim 4 to form covering margins, which provide an all-around covering margin for the brim 4 together with the covering margin in the upper side 40 to considerably improve mounting strength.

The front shape of the brim 4 is preferably a chamfered trapezoid in FIG. 33 or a substantially triangular rice ball shape in FIG. 35 because the bottle wall can be wrapped to the back side of the bilateral protrusions 41 to easily form covering margins, which provide an all-around covering margin for the brim 4 together with the covering margin in the upper side 40.

There is generally a tendency that the covering margin in the upper side 40 is easily formed while the covering margins in the bilateral protrusions 41 are not. That is probably because the large chamfer 42 formed toward both ends in the upper side reduces a resistance, so that wrapping the bottle wall to the back sides of the bilateral protrusions 41 may be accelerated.

Figure 36A:
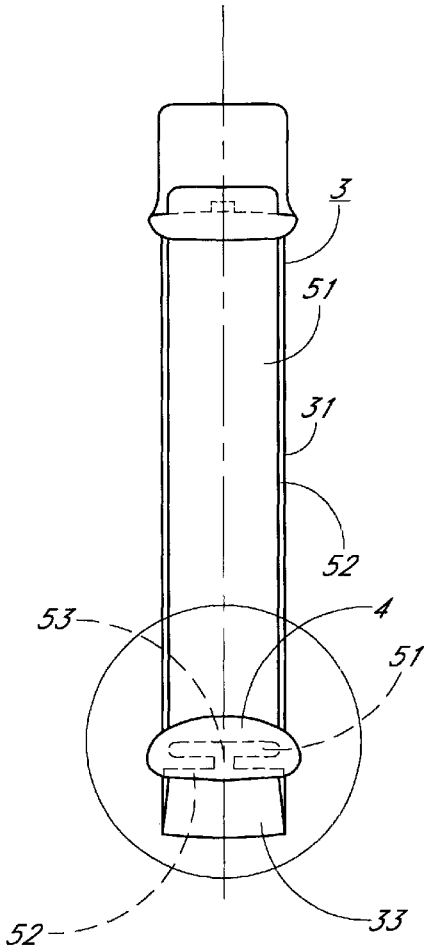
FIG. 36(*a*) and FIG. 36(*b*) shows an example of a handle mounted on a plastic bottle with a handle according to this invention.
Figure 36B:
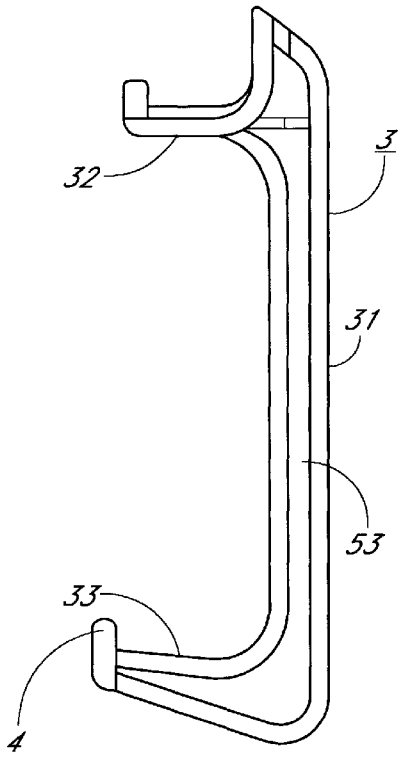
Figure 37:
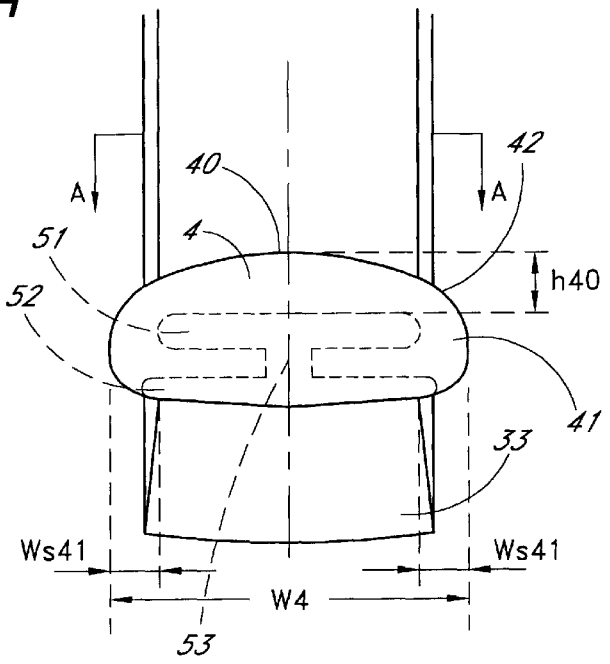
FIG. 37 is an enlarged front view near the lower fitting arm in FIG. 36.
Figure 38:
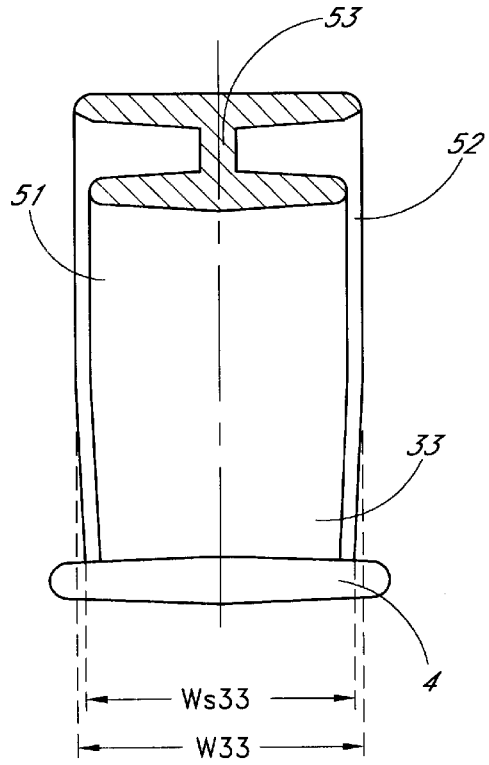
FIG. 38 is a cross section taken on line A—A of FIG. 37.
Figure 39:
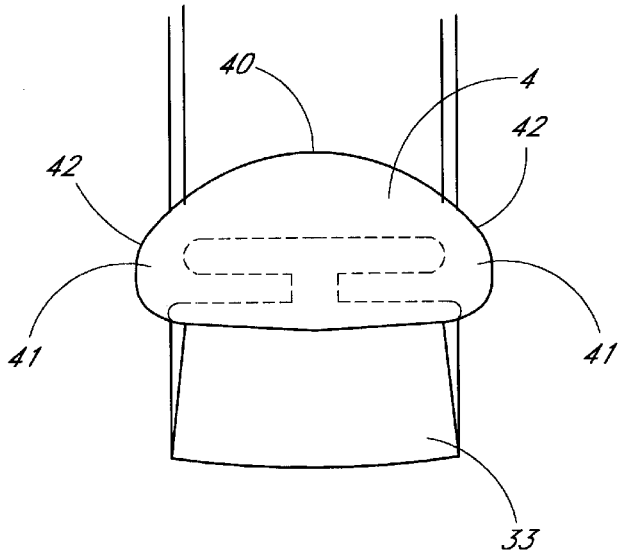
FIG. 39 is an enlarged front view near the lower fitting arm illustrating another example of FIG. 36.

A handle in this invention, as illustrated in its front view in FIG. 36(*a*), its side view in FIG. 36(*b*), FIG. 37 which is an enlarged front view of the region near the lower fitting arm in FIG. 36, FIG. 38 which is a cross section taken on line A—A in FIG. 37 and FIG. 39 which is an enlarged front view of the region near the lower fitting arm in another aspect of FIG. 36, may comprise a grip; fitting arms laterally extended from the upper and the lower ends of the grip; and a continuously protruding brim all around the end of the lower fitting arm, and may have a configuration where large chamfers are formed in both ends of the upper side of the brim, where the side is gradually declined from the highest center toward the bilateral protrusions.

In this embodiment, large chamfers are formed in both ends of the upper side of the continuously protruding brim all around the end of the lower fitting arm and the side is gradually declined from the highest center toward the bilateral protrusions. Thus, the bottle wall may be softly received by the whole surface of the brim, so that the wall may not become thin and smoothly move along the large chamfers in the upper side to sufficiently enfold the both ends of the brim.

This embodiment will be further described with reference to FIGS. 36 to 39. As illustrated in FIGS. 36 to 39, there is provided a handle 3 comprising a grip 31; fitting arms 32, 33 laterally extended from the upper and the lower ends of the grip 31; and a continuously protruding brim 4 all around the end of the lower fitting arm 33, where large chamfers 42 are formed in both ends of the upper side 40 of the brim 4, where the side is gradually declined from the highest center toward the bilateral protrusions 41.

It is preferable that the height $h_{40}$ of the upper side 40 of the brim 4 is 2 to 5 mm, the protrusion width Ws41 of the bilateral protrusions 41 of the brim 4 is 0.5 to 3 mm, and the overall width W4 of the brim 4, although it depends on the size of the bottle, is 20 to 30 mm.

The brim 4 in the handle of this embodiment may be preferably a chamfered trapezoid as shown in the front view in FIG. 37, in which there is formed a large chamfer 42 in the upper side toward both sides where the upper side 40 is gradually declined from the highest center toward the bilateral protrusions 41; or a substantially triangle rice ball shape as shown in the front view in FIG. 39 in which a larger chamfer 42 is formed because the bottle wall can more smoothly move along the large chamfer 42 of the brim to enfold the handle.

If the height h40 of the upper side is less than 2 mm or the protrusion width Ws41 of the bilateral protrusions is less than 0.5 mm, the brim may be insufficiently engaged with the bottle wall to effectively prevent slipping out. If the height h40 of the upper side is more than 5 mm or the protrusion width Ws41 of the bilateral protrusions is more than 3 mm, the bottle wall may inadequately enfold the protruding piece 331, so that a space may be formed between the wall and the upper surface or both sides of the lower fitting arm 33 to give an unpleasant appearance. The above limits are, therefore, preferable.

For the grip 31 and the fitting arms 32, 33 laterally protruding from the upper and the lower ends of the grip 31, the handle of this embodiment may preferably have an H-shaped cross section, in which an inner plate 51 is interconnected with an outer plate 52 via a central vertical rib 53, to make the handle adequately strong while being light.

For the lower fitting arm 33 in the handle of this embodiment, the width W33 in the grip side is preferably larger than the end width Ws33 as illustrated in FIG. 38 because a vertical stress applied from the grip 31 can be dispersed in a large area of the bottle wall under the lower fitting arm 33 and thus buckling distortion may be prevented.

In the handle of this embodiment, the end of the lower fitting arm 33 preferably has an H-shaped cross section (the cross section vertical to the longitudinal direction) as illustrated in FIGS. 36 to 39 to a position near the end face (the position 4 mm under the end face), in which an inner plate 51 is interconnected with an outer plate 52 via a central vertical rib 53. That is because attempting adequate strength without an H-shaped structure, the cross section must be relatively thick and such a thick end may tend to cause a concave (sometimes referred to as a "surface sink") particularly in the end face due to shrinkage during a cooling process in injection-molding of the handle. On the other hand, an H-shaped structure may prevent such a noticeable surface sink.

The handle 3 may be generally manufactured using an injection-molding mold consisting of a sliding and a fixed casts (not shown) which can be divided from the part corresponding to the center of the handle 3. It may be advantageous that the grip 31 or the lower fitting arm 33 has an H-shaped lateral cross section (the cross section vertical to the longitudinal direction) where an inner plate 51 is interconnected with an outer plate 52 via a central rib 53 because it may not form an undercut to be a resistance in the direction of dividing the casts or removing a product handle and thus may facilitate dividing the casts to remove a product handle.

In the bottle with a handle according to this embodiment, the continuously protruding brim is smooth, so that during assembling the bottle body and the handle by blow-molding the body, the bottle wall can smoothly move along the bilateral protrusions 4.1 from the upper side 40 of the brim 4 to enfold the handle. Furthermore, the bottle wall can be advantageously wrapped to the back side of the bilateral protrusions 41 of the brim 4 to form covering margins, which provide an all-around covering margin for the brim 4 together with the covering margin in the upper side 40 to considerably improve mounting strength.

The front shape of the brim 4 is preferably a chamfered trapezoid in FIG. 37 or a substantially triangular rice ball shape in FIG. 39 because the bottle wall can be wrapped to the back side of the bilateral protrusions 41 to easily form covering margins, which provide an all-around covering margin for the brim 4 together with the covering margin in the upper side 40.

There is generally a tendency that the covering margin in the upper side 40 is easily formed while the covering margins in the bilateral protrusions 41 are not. That is probably because the large chamfer 42 formed toward both ends in the upper side 40 reduces a resistance, so that wrapping the bottle wall to the back sides of the bilateral protrusions 41 may be accelerated.

Figure 40A:
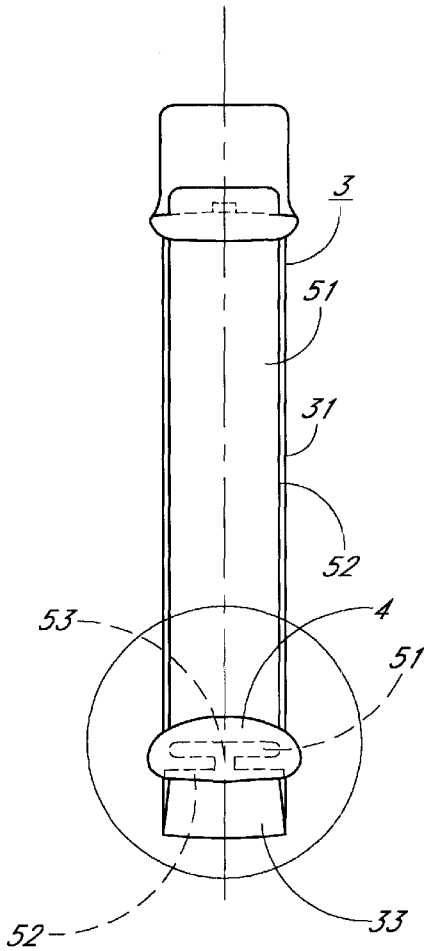
FIG. 40(*a*) and FIG. 40(*b*) shows an example of a handle mounted on a plastic bottle with a handle according to this invention.
Figure 40B:
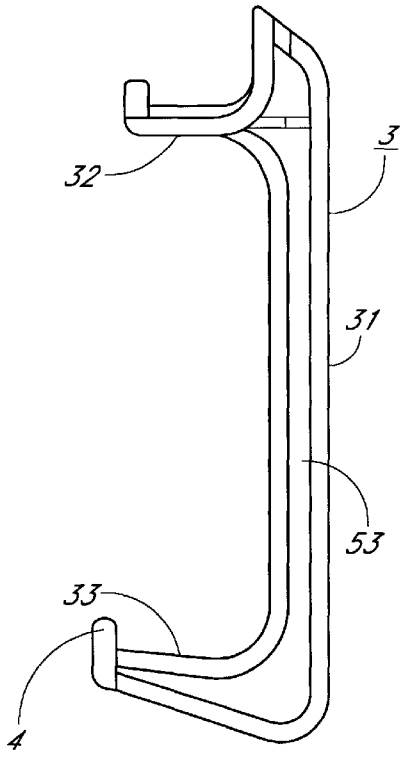
Figure 41:
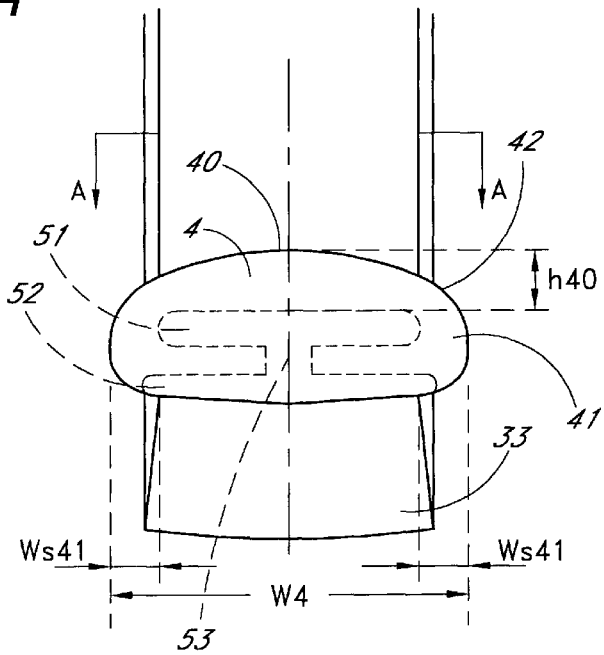
FIG. 41 is an enlarged front view near the lower fitting arm in FIG. 40.
Figure 42:
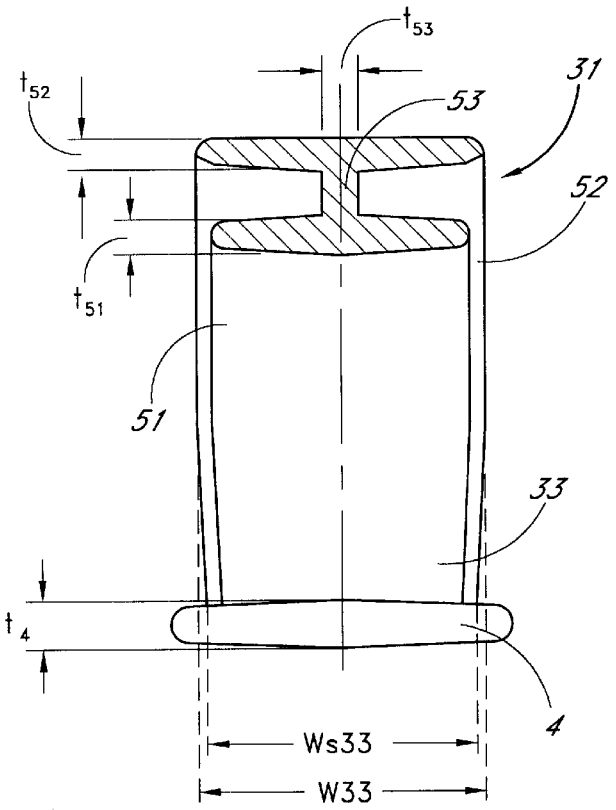
FIG. 42 is a cross section taken on line A—A of FIG. 41.
Figure 43:
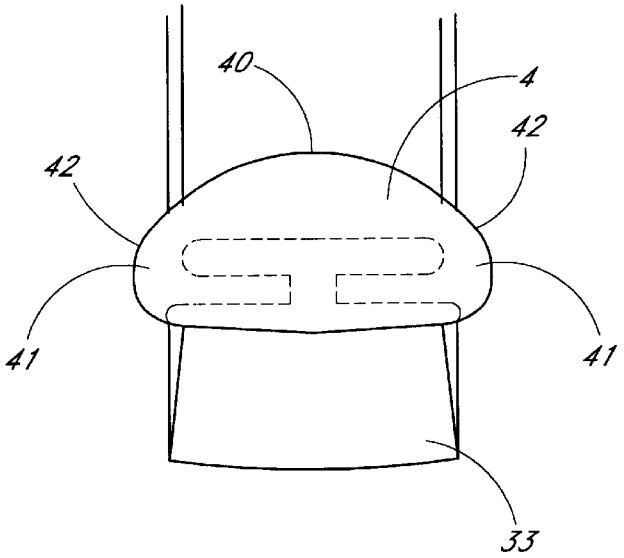
FIG. 43 is an enlarged front view near the lower fitting arm illustrating another example of FIG. 40.
Figure 44:
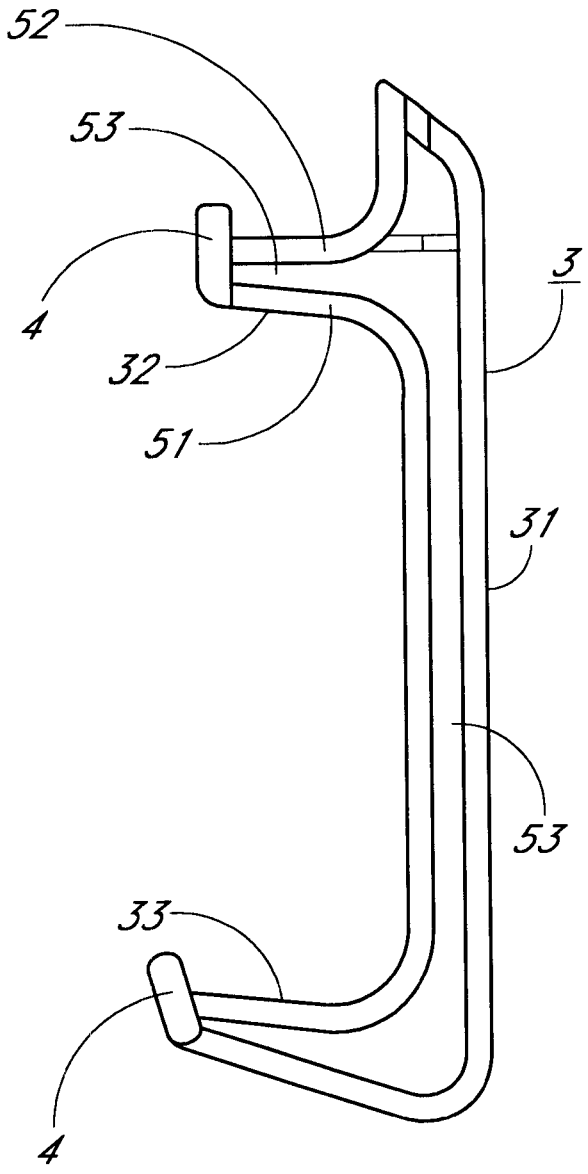
FIG. 44 is a side view illustrating another example of a handle mounted on a plastic bottle with a handle according to this invention.

A handle in this invention, as illustrated in its front view in FIG. 40(*a*), its side view in FIG. 40(*b*), FIG. 41 which is an enlarged front view of the region near the lower fitting arm in FIG. 40, FIG. 42 which is a cross section taken on line A—A in FIG. 41, FIG. 43 which is an enlarged front view of the region near the lower fitting arm in another aspect of FIG. 40 and FIG. 44 which is a side view of another aspect, may comprise a grip; fitting arms laterally extended from the upper and the lower ends of the grip; and a stopper brim plate at the end of the lower fitting arm, and may have a configuration where the lower fitting arm connected with the stopper brim plate has an H-shaped lateral cross section vertical to the longitudinal direction, in which an inner plate is interconnected with an outer plate via a central vertical rib.

In this embodiment, the lower fitting arm connected with the stopper brim plate has an H-shaped lateral cross section vertical to the longitudinal direction, in which an inner plate is interconnected with an outer plate via a central vertical rib. Thus, the handle may be adequately strong while being light. Furthermore, since a thickness is generally constant without a thicker part, there may not be generated a concave (surface sink) due to shrinkage during injection molding in the end face of the stopper brim plate, the bottle wall may smoothly move along the brim plate, and the bottle wall may not become thinner.

This embodiment will be further described with reference to FIGS. 40 to 44. As illustrated in FIGS. 40 to 44, there is provided a handle 3 comprising a grip 31; fitting arms 32, 33 laterally extended from the upper and the lower ends of the grip 31; and a stopper brim plate 4 at the end of the lower fitting arm 33, where the lower fitting arm 33 connected with the stopper brim plate 4 has an H-shaped lateral cross section vertical to the longitudinal direction, in which an inner plate 51 is interconnected with an outer plate 52 via a central vertical rib 53.

The handle 3 of this embodiment, as shown in FIGS. 40 to 44, comprises the stopper brim plate 4 continuously formed from the upper side of the end of the lower fitting arm 33 to both ends. It is preferable that the height $h_{40}$ of the upper side 40 of the stopper brim plate 4 is 2 to 5 mm, the protrusion width Ws41 of the bilateral protrusions 41 of the brim plate 4 is 0.5 to 3 mm, and the overall width W4 of the brim plate 4, although it depends on the size of the bottle, is 20 to 30 mm.

The thickness t4 of the brim plate 4 in the handle of this embodiment is preferably 2.0 to 4.0 mm as illustrated in FIG. 42. If the thickness is less than 2.0 mm, the brim plate may be deformed due to a stress during enfolding by the bottle wall. If the thickness is more than 4.0 mm, there may be easily formed a surface sink in the end face of the brim plate 4. Therefore, the thickness is preferably 2.0 to 4.0 mm. The brim plate 4 may be a chamfered trapezoid as shown in the front view in FIG. 41, in which there is formed a large chamfer 42 in the upper side toward both sides where the upper side 40 is gradually declined from the highest center toward the bilateral protrusions 41; a substantially triangle rice ball shape as shown in the front view in FIG. 43 in which a larger chamfer 42 is formed; or a chamfered rectangle (not shown). The chamfered trapezoid in FIG. 41 or the substantially triangle rice ball shape in FIG. 43 may be preferable because the bottle wall can more smoothly move along the large chamfer 42 of the brim plate to enfold the handle.

If the height h40 is less than 2 mm or the protrusion width Ws41 of the bilateral protrusions is less than 0.5 mm, the brim plate may be insufficiently engaged with the bottle wall to effectively prevent slipping out. If the height h40 is more than 5 mm or the protrusion width Ws41 of the bilateral protrusions is more than 3 mm, the bottle wall may inadequately enfold the protruding piece 4, so that a space may be formed between the bottle wall and the upper surface or both sides of the lower fitting arm 33 to give an unpleasant appearance. The above limits are, therefore, preferable.

For the grip 31 and the fitting arms 32, 33 laterally protruding from the upper and the lower ends of the grip 31, the handle of this embodiment may preferably have an H-shaped cross section, in which an inner plate 51 is interconnected with an outer plate 52 via a central vertical rib 53, to make the handle adequately strong while being light. As shown in FIG. 42, the thicknesses t51, t52 and t53 of the inner plate 51, the outer plate 52 and the central vertical rib 53 are preferably 1.5 to 2.5 mm in the light of strength and prevention of a surface sink.

In the handle of this embodiment, it is essential that the end of the lower fitting arm 33, i.e., to the place connected to the brim plate 4, has an H-shaped cross section (the cross section vertical to the longitudinal direction) as illustrated in FIGS. 40 to 44 to a position near the end face (the position 4 mm under the end face), in which an inner plate 51 is interconnected with an outer plate 52 via a central vertical rib 53.

That is because attempting adequate strength without an H-shaped structure, the cross section must be relatively thick and such a thick end may tend to cause a concave (sometimes referred to as a "surface sink") particularly in the end face of the brim plate 4 due to shrinkage during a cooling process in injection-molding of the handle. On the other hand, an H-shaped structure may prevent such a noticeable surface sink.

The handle 3 may be generally manufactured using an injection-molding mold consisting of a sliding and a fixed casts (not shown) which can be divided from the part corresponding to the center of the handle 3. It may be advantageous that the grip 31 or the lower fitting arm 33 has an H-shaped lateral cross section (the cross section vertical to the longitudinal direction) where an inner plate 51 is interconnected with an outer plate 52 via a central rib 53 because it may not form an undercut to be a resistance in the direction of dividing the casts or removing a product handle and thus may facilitate dividing the casts to remove a product handle.

For the lower fitting arm 33 in the handle of this embodiment, the width W33 in the grip side is preferably larger than the end width Ws33 as illustrated in FIG. 42 because a vertical stress applied from the grip 31 can be dispersed in a large area of the bottle wall under the lower fitting arm 33 and thus buckling distortion may be prevented.

The handle of this invention may have a configuration where the brim plate 4 formed at the end of the lower fitting arm 33 is oblique while being up in front as illustrated in FIG. 44, or where a stopper brim plate 4 is also formed at the end of the upper fitting arm 32 and the upper fitting arm 32 connected with the brim plate 4 has an H-shaped cross section vertical to the longitudinal direction, in which an inner plate 51 is interconnected with an outer plate 52 via a central vertical rib 53.

Most preferably, the brim plate 4 in this embodiment does not protrude to the lower surface of the lower fitting arm 33 as illustrated in FIGS. 40, 41, 43 and 44 because the bottle wall may be smoothly extended outward owing to a relatively small friction between the wall and the lower surface of the end of the lower fitting arm in the handle, so that the bottle wall can have an adequate thickness even in an outer region. Alternatively, the brim plate may protrude as a lower side to a lower level than the upper side (not shown).

In the bottle with a handle according to this embodiment, the continuously protruding brim is smooth, so that during assembling the bottle body and the handle by blow-molding the body, the bottle wall can smoothly move along the bilateral protrusions 41 from the upper side 40 of the brim 4 to enfold the handle. Furthermore, the bottle wall can be advantageously wrapped to the back side of the bilateral protrusions 41 of the brim 4 to form covering margins, which provide an all-around covering margin for the brim 4 together with the covering margin in the upper side 40 to considerably improve mounting strength.

The front shape of the brim 4 is preferably a chamfered trapezoid in FIG. 41 or a substantially triangular rice ball shape in FIG. 43 because the bottle wall can be wrapped to the back side of the bilateral protrusions 41 to easily form covering margins, which provide an all-around covering margin for the brim 4 together with the covering margin in the upper side 40.

There is generally a tendency that the covering margin in the upper side 40 is easily formed while the covering margins in the bilateral protrusions 41 are not. That is probably because the large chamfer 42 formed toward both ends in the upper side 40 reduces a resistance, so that wrapping the bottle wall to the back sides of the bilateral protrusions 41 may be accelerated.

This invention will be more specifically described with reference to examples.

EXAMPLE 1

As illustrated in FIG. 1, in a blow mold was set a polypropylene or polyethylene-terephthalate handle 3 comprising a grip 30 and fitting arms 32, 33 laterally protruding from the upper and the lower ends of the grip 31 where the height h4 and the width w4 of the protruding piece 331 were 3 mm and 10 mm, respectively. Then, 50 g of a polyethylene-terephthalate preform 5 was then blow-molded by heating at 95° C. In both polypropylene and polyethylene-terephthalate handles, the thinnest part in the bottle wall 21 under the lower fitting arm 33 kept a thickness of 0.1 mm with no holes.

COMPARATIVE EXAMPLE 1

Blow molding was conducted as described in Example 1, except using a conventional handle 3 in which a protruding piece 342 was formed in the lower surface at the end of a fitting arm 33 as shown in FIG. 3. For the polypropylene handle, there were no holes in the bottle wall 21 under the lower fitting arm 33, but its thinnest part was as thin as 0.05 mm. For the polyethylene-terephthalate handle, a hole was sometimes formed in the bottle wall 21 under the lower fitting arm 33.

EXAMPLE 2

As illustrated in FIG. 25, beforehand in a blow mold was set a polypropylene or polyethylene-terephthalate handle 3 comprising a grip 31 and fitting arms 32, 33 laterally protruding from the upper and the lower ends of the grip 31 where the height h1 and the width w1 of the protruding piece 331 were 3 mm and 10 mm, respectively; and the chamfer 12 was a slope having a cross section taken on line C—C to the part from the end of the lower fitting arm 33 to the position at 8 mm from the end in which the width w2 and the height h2 were 2 mm and 1 mm, respectively and the inner end 121 and the outer end 122 were curved with r=1 mm and 5 mm, respectively. Then, 50 g of a polyethylene-terephthalate preform was then blow-molded by heating at 95° C. In both polypropylene and polyethylene-terephthalate handles, the thinnest part in the bottle wall under the lower fitting arm 33 kept a thickness of 0.1 mm with no holes.

EXAMPLE 3

As illustrated in FIGS. 26(*a*), (*b*) and (*c*), in a blow mold was set a polypropylene or polyethylene-terephthalate handle 3 comprising a grip 31 and fitting arms 32, 33 laterally protruding from the upper and the lower ends of the grip 31 where the height h1 and the width w1 of the protruding piece 331 were 3 mm and 10 mm, respectively, and the height h2 and the width w2 of the downward hook 332 were 1.5 mm and 27 mm, respectively. Then, 50 g of a polyethylene-terephthalate preform 5 was then blow-molded by heating at 95° C. In both polypropylene and polyethylene-terephthalate handles, the thinnest part in the bottle wall 11 under the lower fitting arm 33 kept a thickness of 0.1 mm with no holes.

EXAMPLE 4

As shown in FIG. 28, a plastic bottle with a handle was prepared by insert molding using a blow mold corresponding to a plastic bottle whose maximum diameter, height and volume were 100 mm, 300 mm and 1.8 L, respectively, and a handle 3 comprising a grip 31 and fitting arms 32, 33 laterally protruding from the upper and the lower ends of the grip 31 where the overall width W and the height H of the lateral hook 333 were 25 mm and 1 mm, respectively. The prepared plastic bottle with a handle was evaluated for a handle-mounting strength as described below and slipping out of the handle 3 was not observed.

(Determination of a Handle-mounting Strength)

After vertically dropping a capped sample filled with 1.8 L of water whose bottom was downside, on a concrete floor face from a height of 1.2 m, the number of bottles in which a handle 3 slipped out from the plastic bottle body was counted among twenty tested bottles.

COMPARATIVE EXAMPLE 2

A plastic bottle with a handle was prepared as described in Example 4, except that the overall width W of the lateral hook 333 was 18 mm or 32 mm. For the overall width W of 18 mm, the lower fitting arm was deformed. For the overall width W of 32 mm, it was too wide for the inner wall to enfold the handle, leading to rejection of the product.

COMPARATIVE EXAMPLE 3

A plastic bottle with a handle was prepared as described in Example 4, except that the height H of the lateral hook 333 was 0.5 mm or 1.5 mm. For the height H of 0.5 mm, slipping-out of the handle indicating a reduced handle-mounting strength was observed in three of twenty tested bottles. For the height H of 1.5 mm, a hole was observed on the inner wall in contact with the hook.

EXAMPLES 5 and 6

As illustrated in FIGS. 32 and 33, beforehand in a blow mold for a 1.8 L bottle was set a polypropylene handle 3(Example 5) or polyethylene-terephthalate handle 3(Example 6) comprising a grip 31 and fitting arms 32, 33 laterally protruding from the upper and the lower ends of the grip 31 where the height h40 of the upper side 40 of the brim 4 and the protruding width Ws41 of the bilateral protrusions 41 were 3.5 mm and 2 mm, respectively and the chamfer 42 with a radius of curvature of 10 mm was formed. Then, 62 g of a polyethylene-terephthalate preform was then blow-molded by heating at 107° C. Both polypropylene and polyethylene-terephthalate handles provided a good plastic bottle with a handle in which the thinnest part in the bottle wall under the lower fitting arm 33 kept a thickness of 0.25 mm with no holes.

For the prepared plastic bottles with a handle, a mounting strength was determined as described below. In both Examples 5 and 6, a handle-mounting strength was 50 kgf, which was considerably larger than an acceptable value of 25 kgf for practical use.

(Determination of a Mounting Strength)

Using a tension tester, a bottle body was fixed lying sideways. The handle 3 was seized on the highest center of the grip 31 and vertically pulled to determine its tensile strength, whose maximum was defined to be a mounting strength (A bottle can be practically used when a mounting strength is 25 kgf or more).

COMPARATIVE EXAMPLES 4 and 5

Blow molding was conducted as described in Example 5 or 6, except using a conventional handle 3 in which outward (downward) protruding pieces 42 were formed at the ends of fitting arms 32 and 33 as shown in FIG. 3. For the polypropylene handle 3 (Comparative Example 4), there were no holes in the bottle wall 21 under the lower fitting arm 33, but its thinnest part was as thin as 0.15 mm. For the polyethylene-terephthalate handle 3 (Comparative Example 5), a hole was sometimes formed in the bottle wall 21 under the lower fitting arm 33.

For the prepared plastic bottles with a handle, a mounting strength was determined as described in Example 5 or 6. The bottle of Comparative Example 4 exhibited a practical value of 40 kgf. On the other hand, a hole was formed in the bottle of Comparative Example 5, so that a mounting strength was not determined.

What is claimed is:

1. A handle for a blow-molded plastic bottle, which is fixed to a bottle wall by blow-molding, said handle being U-shaped and having a grip and two fitting arms protruding from the grip, said two fitting arms being an upper fitting arm and a lower fitting arm, each fitting arm having an end portion adapted to be embedded in a bottle wall, said end portion of each fitting arm having a projection, said lower fitting arm having an upper surface and a lower surface wherein the lower surface of the lower fitting arm has substantially no projection, said lower surface of the lower fitting arm being adapted to contact a bottle wall and being formed approximately in a direction in which a bottle wall is extended by blow-molding.

2. A handle for a blow-molded plastic bottle as claimed in claim 1, where a small corrugation is formed on the surface of the projection of the lower fitting arm to be in contact with the bottle body.

3. A handle for a blow-molded plastic bottle as claimed in claim 1, where the cross-sectional shape of the grip in the handle is H-shaped and the inner piece is narrower than the outer piece.

4. A handle for a blow-molded plastic bottle as claimed in claim 1, comprising a fitting whose lateral cross section in a part connected to the projection is T-shaped or cruciform consisting of a lateral wall and a vertical wall downwardly adjacent to the lateral wall in almost its center, the contact surface of the lower fitting arm near the border where the lower fitting arm is in contact with the bottle wall is relatively wider, and the lowest end of the lower fitting arm is almost in the longitudinal center of the lower fitting arm, and the height from the lowest end to the upper surface of the end of the projection of the lower fitting arm is 0.5 to 2.5 times as large as the horizontal distance from the lowest end of the handle to the end of the lower fitting arm.

5. A handle for a blow-molded plastic bottle as claimed in claim 1, having an H-shaped lateral cross section from a grip in the handle to its upper and lower fitting arms where an inner plate is interconnected with an outer plate via a central rib, and comprising a lateral rib perpendicular to the central rib where there is formed a drain hole penetrating the central rib above the lateral rib.

6. A blow-molded plastic bottle with a handle where a handle for a blow-molded plastic bottle as claimed in claim 5 is mounted by embedding it into the concave formed on the side of the bottle body for mounting a handle.

7. A handle for a blow-molded plastic bottle as claimed in claim 1, where a protrusion which extends to a grip side in the handle is further formed at the end of the projection formed upward at the end of the lower fitting arm.

8. A blow-molded plastic bottle with a handle where a handle for a blow-molded plastic bottle as claimed in claim 7 is mounted by embedding it into the concave formed on the side of the bottle body for mounting a handle.

9. A handle for a blow-molded plastic bottle as claimed in claim 1, having an H-shaped lateral cross section from a grip in the handle to its upper and lower fitting arms where an inner plate is interconnected with an outer plate via a central rib, and comprising reinforcing rib within a fitting arm below a grip, which extends in a lateral direction and interconnects the inner plate with the outer plate.

10. A blow-molded plastic bottle with a handle where a handle for a blow-molded plastic bottle as claimed in claim 9 is mounted by embedding it into the concave formed on the side of the bottle body for mounting a handle.

11. A handle for a blow-molded plastic bottle as claimed in claim 1, where a projection is formed on the surface of the end of the lower fitting arm and upward concave fitting parts are formed at both ends of the lower surface of the lower fitting arm.

12. A blow-molded plastic bottle with a handle where a handle for a blow-molded plastic bottle as claimed in claim 11 is mounted by embedding it into the concave formed on the side of the bottle body for mounting a handle.

13. A handle for a blow-molded plastic bottle as claimed in claim 1, being made from a transparent or translucent resin, having an H-shaped lateral cross section from a grip in the handle to its upper and lower fitting arms where an inner plate is interconnected with an outer plate via a central rib, and comprising a corrugation at least in a part corresponding to the central rib of the outer surface of the outer plate of the grip.

14. A blow-molded plastic bottle with a handle where a handle for a blow-molded plastic bottle as claimed in claim 13 is mounted by embedding it into the concave formed on the side of the bottle body for mounting a handle.

15. A handle for a blow-molded plastic bottle as claimed in claim 1, being made from a polyester resin, having a thickness of less than 2.5 mm and more than 1.5 mm, having an H-shaped lateral cross section from a grip in the handle to its upper and lower fitting arms where an inner plate is interconnected with an outer plate via a central rib, and comprising a central rib, but not lateral ribs, at least in the grip.

16. A blow-molded plastic bottle with a handle where a handle for a blow-molded plastic bottle as claimed in claim 15 is mounted by embedding it into the concave formed on the side of the bottle body for mounting a handle.

17. A handle for a blow-molded plastic bottle as claimed in claim 1, where a display using depressions is provided in a half outer surface from the center line of the grip in the handle.

18. A blow-molded plastic bottle with a handle where a handle for a blow-molded plastic bottle as claimed in claim 17 is mounted by embedding it into the concave formed on the side of the bottle body for mounting a handle.

19. A handle for a blow-molded plastic bottle as claimed in claim 1, having an H-shaped lateral cross section in its grip where an inner plate is interconnected with an outer plate via a central rib, and where a notch is formed on the top wall of the grip, there are provided lateral ribs at intervals below the top wall which interconnect the inner plate to the outer plate, and a notch is formed on the side of the lateral rib, wherein the above notches are aligned in a line.

20. A blow-molded plastic bottle with a handle where a handle for a blow-molded plastic bottle as claimed in claim 19 is mounted by embedding it into the concave formed on the side of the bottle body for mounting a handle.

21. A handle for a blow-molded plastic bottle as claimed in claim 1, having an H-shaped lateral cross section in the grip of the handle where an inner plate is interconnected with an outer plate via a central rib, and where chamfers are formed in both sides of the inner surface of the inner plate to improve its gripping touch, said chamfers having a width equal to 12 to 25% of the width of the inner plate and an angle of 15 to 30°.

22. A blow-molded plastic bottle with a handle where a handle for a blow-molded plastic bottle as claimed in claim 21 is mounted by embedding it into the concave formed on the side of the bottle body for mounting a handle.

23. A handle for a blow-molded plastic bottle as claimed in claim 1, having an H-shaped lateral cross section in the grip of the handle where an inner plate is interconnected with an outer plate via a central rib, and where non-slip corrugations are formed only near both edges in one or both of the inner and the outer plates.

24. A blow-molded plastic bottle with a handle where a handle for a blow-molded plastic bottle as claimed in claim 23 is mounted by embedding it into the concave formed on the side of the bottle body for mounting a handle.

25. A handle for a blow-molded plastic bottle as claimed in claim 1, where there is formed a projection narrower than the lower fitting arm on the upper side of the end in the lower fitting arm and both edges of the upper surface of the lower fitting arm are chamfered.

26. A blow-molded plastic bottle with a handle where a handle for a blow-molded plastic bottle as claimed in claim 25 is mounted by embedding it into the concave formed on the side of the bottle body for mounting a handle.

27. A handle for a blow-molded plastic bottle as claimed in claim 1, comprising a display as a plain pattern in a basic pattern consisting of fine depressions in the outer surface of the grip in the handle.

28. A blow-molded plastic bottle with a handle where a handle for a blow-molded plastic bottle as claimed in claim 27 is mounted by embedding it into the concave formed on the side of the bottle body for mounting a handle.

29. A handle for a blow-molded plastic bottle as claimed in claim 1, where the lateral cross section of the projection formed on the upper side of the end of the lower fitting arm is a trapezoid which is tapered toward the end of the fitting arm.

30. A blow-molded plastic bottle with a handle where a handle for a blow-molded plastic bottle as claimed in claim 29 is mounted by embedding it into the concave formed on the side of the bottle body for mounting a handle.

31. A handle for a blow-molded plastic bottle as claimed in claim 1, where a flat concave is formed in the lower part of the inside of the grip by thinning the grip.

32. A blow-molded plastic bottle with a handle where a handle for a blow-molded plastic bottle as claimed in claim 31 is mounted by embedding it into the concave formed on the side of the bottle body for mounting a handle.

33. A blow-molded plastic bottle with a handle, comprising:

(i) a blow-molded bottle body made from polyester resin; and (ii) a handle made of polyester resin fixed to a wall of the bottle body by blow-molding, said handle being U-shaped and having a grip and two fitting arms protruding from the grip;

said two fitting arms being an upper fitting arm and a lower fitting arm, each fitting arm having an end portion embedded in the wall, said end portion of each fitting arm having a projection, said lower fitting arm having an upper surface and a lower surface wherein the lower surface of the lower fitting arm has substantially no projection, said lower surface of the lower fitting arm contacting a wall of the bottle body and being formed approximately in a direction in which a bottle wall is extended by blow-molding.

34. A blow-molded plastic bottle with a handle as claimed in claim 33, where a small corrugation is formed on the surface of the projection of the lower fitting arm to be in contact with the bottle body.

35. A blow-molded plastic bottle with a handle as claimed in claim 33, where the cross-sectional shape of the grip in the handle is H-shaped and the inner piece is narrower than the outer piece.

36. A blow-molded plastic bottle with a handle as claimed in claim 33, where a handle comprising a fitting whose lateral cross section in a part connected to the projection is T-shaped or cruciform consisting of a lateral wall and a vertical wall downwardly adjacent to the lateral wall in almost its center, the contact surface of the lower fitting arm near the border where the lower fitting arm is in contact with the bottle wall is relatively wider, and the lowest end of the lower fitting arm is almost in the longitudinal center of the lower fitting arm, and the height from the lowest end to the upper surface of the end of the projection of the lower fitting arm is 0.5 to 2.5 times as large as the horizontal distance from the lowest end of the handle to the end of the lower fitting arm.

37. A blow-molded plastic bottle with a handle as claimed in claim 33, comprising a bottle body made of a polyester resin mainly consisting of polyethylene terephthalate and a handle made of a recycled polyester resin mainly consisting of polyethylene terephthalate whose intrinsic viscosity is 0.68 or less, and at least the surface of the handle being whitened by crystallization.

38. A blow-molded plastic bottle with a handle as claimed in claim 33, where the end surface of a lower fitting arm is closer to the bottle outer wall than the end surface of an upper fitting arm.

39. A blow-molded plastic bottle with a handle as claimed in claim 33, where a lateral hook is formed at the end of the lower fitting arm, the overall width of the lateral hook is 20 to 30% of the maximum diameter of the plastic bottle and the height of the lateral hook is 3 to 6% of the overall width of the lateral hook.

40. A handle for a blow-molded plastic bottle, which is fixed to a bottle wall by blow-molding, said handle being U-shaped and having a grip and two fitting arms protruding from the grip, said two fitting arms being an upper fitting arm and a lower fitting arm, each fitting arm having an end portion adapted to be embedded in a bottle wall, said end portion of the upper fitting arm having a projection, said lower fitting arm having an upper surface and a lower surface wherein the upper surface of the lower fitting arm has a upward projection having a height of 2 to 5 mm and the lower surface of the lower fitting arm has a downward hook having 60% or less of the height of the upward projection, said lower surface of the lower fitting arm being adapted to contact a bottle wall and being formed approximately in a direction in which a bottle wall is extended by blow-molding.

41. A blow-molded plastic bottle with a handle where a handle for a blow-molded plastic bottle as claimed in claim 40 is mounted by embedding it into the concave formed on the side of the bottle body for mounting a handle.

42. A handle for a blow-molded plastic bottle, which is fixed to a bottle wall by blow-molding, said handle being U-shaped and having a grip and two fitting arms protruding from the grip, said two fitting arms being an upper fitting arm and a lower fitting arm, each fitting arm having an end portion adapted to be embedded in a bottle wall, said end portion of the upper fitting arm having a projection, said end portion of the lower fitting arm having a brim, said lower fitting arm having an upper surface and a lower surface, said brim continuously protruding from the upper surface of the end of the lower fitting arm and substantially no protrusion being formed on the lower surface of the end of the lower fitting arm, said lower surface of the lower fitting arm being adapted to contact a bottle wall and being formed approximately in a direction in which a bottle wall is extended by blow-molding.

43. A blow-molded plastic bottle with a handle where a handle for a blow-molded plastic bottle as claimed in claim 42 is mounted by embedding it into the concave formed on the side of the bottle body for mounting a handle.

44. A handle for a blow-molded plastic bottle, which is fixed to a bottle wall by blow-molding, said handle being U-shaped and having a grip and two fitting arms protruding from the grip, said two fitting arms being an upper fitting arm and a lower fitting arm, each fitting arm having an end portion adapted to be embedded in a bottle wall, said end portion of the upper fitting arm having a projection, said end portion of the lower fitting arm having a brim, said lower fitting arm having an upper surface and a lower surface, said brim continuously protruding all around the end of the lower fitting arm and substantially no protrusion being formed on the lower surface of the end of the lower fitting arm, said lower surface of the lower fitting arm being adapted to contact a bottle wall and being formed approximately in a direction in which a bottle wall is extended by blow-molding.

45. A blow-molded plastic bottle with a handle where a handle for a blow-molded plastic bottle as claimed in claim 44 is mounted by embedding it into the concave formed on the side of the bottle body for mounting a handle.

46. A handle for a blow-molded plastic bottle, which is fixed to a bottle wall by blow-molding, said handle being U-shaped and having a grip and two fitting arms protruding from the grip, said two fitting arms being an upper fitting arm and a lower fitting arm, each fitting arm having an end portion adapted to be embedded in a bottle wall, said end portion of the upper fitting arm having a projection, said end portion of the lower fitting arm having a stopper brim plate, said lower fitting arm having an upper surface and a lower surface wherein the lower surface of the lower fitting arm has substantially no projection, said lower fitting arm having a lateral H-shaped cross-section, said lower surface of the lower fitting arm being adapted to contact a bottle wall and being formed approximately in a direction in which a bottle wall is extended by blow-molding.

47. A blow-molded plastic bottle with a handle where a handle for a blow-molded plastic bottle as claimed in claim 46 is mounted by embedding it into the concave formed on the side of the bottle body for mounting a handle.

* * * * *